US010239742B2

(12) United States Patent
Dresser et al.

(10) Patent No.: US 10,239,742 B2
(45) Date of Patent: Mar. 26, 2019

(54) SEMI-AUTOMATED BEVERAGE DISPENSING MACHINES AND METHODS

(71) Applicant: Cornelius, Inc., St. Paul, MN (US)

(72) Inventors: Zachary Dresser, West Chicago, IL (US); Slawomir Kielian, Des Plaines, IL (US); Anthony Caringella, Norridge, IL (US)

(73) Assignee: Cornelius, Inc., Osseo, MN (US)

( * ) Notice: Subject to any disclaimer, the term of this patent is extended or adjusted under 35 U.S.C. 154(b) by 103 days.

(21) Appl. No.: 15/148,114

(22) Filed: May 6, 2016

(65) Prior Publication Data

US 2017/0096324 A1 Apr. 6, 2017

Related U.S. Application Data

(60) Provisional application No. 62/236,578, filed on Oct. 2, 2015.

(51) Int. Cl.
*B67D 1/08* (2006.01)
*B65B 43/48* (2006.01)
(Continued)

(52) U.S. Cl.
CPC ..... *B67D 1/0894* (2013.01); *A47F 1/085* (2013.01); *B65B 43/48* (2013.01); *B67D 1/0881* (2013.01);
(Continued)

(58) Field of Classification Search
CPC ..... B65B 43/48; B65B 43/54; B65B 43/56; B67D 1/0894; B67D 2210/00065; B67D 2210/00076
See application file for complete search history.

(56) References Cited

U.S. PATENT DOCUMENTS 2,144,835 A 1/1939 Dickinson
2,239,395 A 4/1941 Mallory
(Continued)

FOREIGN PATENT DOCUMENTS

GB 2509521 7/2014

OTHER PUBLICATIONS

International Search Report and Written Opinion, PCT/US2016/036832, dated Nov. 15, 2016.

*Primary Examiner* — Timothy L Maust
*Assistant Examiner* — Timothy P Kelly
(74) *Attorney, Agent, or Firm* — Andrus Intellectual Property Law, LLP

(57) ABSTRACT

Food product dispensing machines and methods for dispensing food product into a cup. The food product dispensing machine includes a cup holder having a target element, a sensor that senses the target element, and a controller. The cup holder is configured to hold a cup such that the cup prevents the sensor from sensing at least a portion of the target element. The controller determines whether a cup is present in the cup holder and/or a size of the cup based on a remaining portion of the target element that is sensed by the sensor when the cup is held by the cup holder. Drive mechanisms are configured to move the first and second cup holders along first and second radial paths, respectively, with respect to the common dispensing position. An indicator is configured to indicate a remaining number of cup dispenses to the user.

22 Claims, 18 Drawing Sheets

(51) Int. Cl.
*A47F 1/08* (2006.01)
*B67D 1/12* (2006.01)

(52) U.S. Cl.
CPC ..... *B67D 1/0888* (2013.01); *B67D 1/124* (2013.01); *B67D 1/1236* (2013.01); *B67D 2210/00065* (2013.01); *B67D 2210/00076* (2013.01)

(56) References Cited

U.S. PATENT DOCUMENTS 2,609,915 A 9/1952 De Burgh
2,824,638 A 2/1958 De Burgh
3,364,959 A * 1/1968 Hamilton ..... B67D 1/06 141/155
3,915,207 A * 10/1975 Greenfield, Jr. ..... A47J 31/401 141/103
4,202,387 A 5/1980 Upton
4,437,499 A 3/1984 Devale
4,469,150 A 9/1984 Grimaldi
4,590,975 A 5/1986 Credle, Jr.
4,949,526 A 8/1990 Brogna et al.
5,000,345 A 3/1991 Brogna et al.
5,129,548 A 7/1992 Wisniewski
5,343,716 A 9/1994 Swanson et al.
5,390,714 A 2/1995 North, III et al.
5,607,083 A 3/1997 Vogel et al.
6,053,359 A 4/2000 Goulet et al.
6,102,246 A 8/2000 Goulet et al.
6,450,369 B1 9/2002 Heyes
6,648,185 B1 11/2003 Henry et al.
7,269,960 B2 9/2007 Elsom et al.
7,597,187 B2 10/2009 Bausenwein et al.
RE41,760 E 9/2010 Thompson et al.
8,297,471 B2 10/2012 Dooley et al.
8,565,916 B2 10/2013 Zhang et al.
8,616,366 B2 12/2013 Ishino et al.
8,739,840 B2 6/2014 Mattos, Jr. et al.
8,757,222 B2 6/2014 Rudick et al.
8,770,446 B2 7/2014 Sevcik et al.
8,893,926 B2 11/2014 Anderson et al.
9,010,577 B2 4/2015 Hoover
9,017,485 B2 4/2015 Murthy et al.
9,045,323 B2 6/2015 Crane et al.
9,067,775 B2 6/2015 Mattos, Jr. et al.
9,141,562 B2 9/2015 Pickett et al.
9,150,366 B2 10/2015 Rudick et al.
2008/0164274 A1 7/2008 Stettes
2012/0295358 A1 11/2012 Ariff et al.
2013/0220480 A1 8/2013 Angus et al.
2014/0041748 A1 2/2014 Angus et al.
2015/0298956 A1 10/2015 Rudick et al.

* cited by examiner

SEMI-AUTOMATED BEVERAGE DISPENSING MACHINES AND METHODS

CROSS-REFERENCE TO RELATED APPLICATION

The present application claims priority to U.S. Provisional Patent Application No. 62/236,578, filed on Oct. 2, 2015, which is hereby incorporated herein by reference.

FIELD

The present disclosure relates to food product dispensing machines, specifically semi-automated beverage dispensing machines.

BACKGROUND

The following patents are incorporated herein by reference in entirety:

U.S. Pat. No. 5,343,716 discloses a cold plate beverage dispenser having a cold plate that is oriented within a housing of a dispenser such that the fluid lines extending through the cold plate extend in a pattern, which prevents ice bridging from occurring at the back end of the device. The cold plate includes stainless steel wire coils within each water line along an end portion for turbulating the water as it passes therethrough to provide for enhanced heat exchange between the fluid, the cold plate and the fluid line end portion.

U.S. Pat. No. 6,450,369 discloses a beverage dispenser that provides desired ratios of mixed concentrate and diluent more accurately. The dispenser includes a valve housing having an inlet and an outlet for a concentrate; an inlet and an outlet for a diluent; and a reciprocating piston in a central passageway between the inlets and outlets. The piston is reciprocally movable between a first position in which flow to both outlets is blocked and a second position in which both outlets are open to flow. A flow rate sensor is for the concentrate and a flow rate sensor is for the diluent. The sensors are connected to a controller such that the diluent flow rate is adjusted by movement of the piston according to the concentrate flow rate to achieve a predetermined ratio of concentrate to diluent for the dispensed beverage.

U.S. Pat. No. 8,770,446 discloses a system and method for dispensing a predetermined portion of a beverage or drink additive using a cost effective portion control valve that replaces electrical components with mechanical components. A controlled portion of a beverage is dispensed when a lever is activated. A magnetically coupled linkage system can control the exact amount of fluid dispensed. A valve block contains a beverage input, a beverage outlet, and a valve seal. A lever arm is connected to the valve seal and connected to a magnetic housing containing a valve magnet. A yoke pivots about the valve block. The yoke contains a yoke magnet aligned to interface with the valve magnet. A lever arm return spring is connected to the lever arm and the valve block to bias the lever arm return spring to a resting position. As the yoke pivots beyond a predetermined distance, the yoke magnet separates from the valve magnet allowing the lever arm to return to the resting position closing the valve.

U.S. Pat. No. 9,045,323 discloses a process for dispensing a beverage into a cup including: providing a dispensing structure; providing a transportation mechanism linked with the dispensing structure; providing a staging structure linked with the transportation structure; providing a control system linked with the dispensing structure, staging structure and the transportation mechanism; providing a sensor mechanism linked with the control system, the sensor mechanism providing signals indicating the position of a cup; providing a cup identification system having an interactive display connected to the control system; picking a cup from a storage device and positioning it within a dispensing structure; dispensing ice and a beverage at separate locations within the dispensing structure; transporting the filled beverage to a staging structure; positioning the filled cup in the staging structure; and removing the filled cup from the staging structure for sale to a customer wherein the cup identification system and the display outputs visual characteristics indicating the position and characteristics of a cup at every stage of the process.

U.S. Pat. No. 9,010,577 discloses a fountain beverage dispenser for constituting a beverage by mixture of a syrup and a diluent for the syrup. A highly concentrated beverage syrup supply and at least one diluent and syrup blending station are used for diluting the highly concentrated syrup with diluent before the diluted syrup is mixed with diluent in the final mixture of syrup and diluent delivered to a dispensing nozzle.

U.S. Pat. No. 9,017,485 discloses an ice dispensing system that includes an ice hopper structure including a plurality of walls having inner surfaces that define an inner volume storing ice therein. The ice hopper may include a drain. A cleaning structure is coupled to the ice hopper structure. The cleaning structure includes a pump linked to a spray mechanism positioned within the inner volume of the ice hopper structure. The spray mechanism disperses a liquid on an inner surface of the ice hopper structure during a cleaning cycle of the ice dispensing mechanism.

SUMMARY

This Summary is provided to introduce a selection of concepts that are further described herein in the Detailed Description. This Summary is not intended to identify key or central features from the claimed subject matter, nor is it intended to be used as an aid in limiting the scope of the claimed subject matter.

In certain examples, a food product dispensing machine is for dispensing food product into a cup. The food product dispensing machine comprises a cup holder that includes a target element and a sensor that is configured to sense the target element. The cup holder is configured to hold the cup such that the cup prevents the sensor from sensing at least a portion of the target element. A controller is configured to determine a size of the cup based on a remaining portion of the target element that is sensed by the sensor when the cup is held by the cup holder.

In certain examples, a method is for determining cup size in a food product dispensing machine for dispensing food product. The method comprises placing a cup in a cup holder; sensing a remaining portion of the target element associated with the cup holder that is not obstructed by the cup; determining a size of the cup based on the remaining portion of the target element; and indicating the size of the cup to a user of the food product dispensing machine.

In certain examples, a food product dispensing machine is for dispensing food product. The food product dispensing machine includes a food product dispenser; a first cup holder that is configured to hold a first cup; a first drive mechanism that is configured to move the first cup holder on a deck between a first staging position for receiving the first cup in the first cup holder and a common dispensing position for receiving food product from the food product dispenser; a second cup holder that is configured to hold a second cup; and a second drive mechanism that is configured to move the second cup holder on the deck between a second staging position for receiving the second cup in the second cup holder and the common dispensing position. The first and second drive mechanisms are configured to move the first and second cup holders along first and second radial paths, respectively, with respect to the common dispensing position.

In certain examples, a food product dispensing machine is provided with a cup dispenser having a first cup housing that is configured to hold a plurality of cups. The first cup housing has a first outlet through which a user can manually dispense cups. A first dispense sensor is configured to sense cups that are dispensed through the outlet. An indicator is coupled to the cup dispenser and configured to indicate a remaining number of cup dispenses to the user. The indicator comprises a plurality of lights. A controller is configured to receive beverage order data from a user and to control the indicator based on the cup dispenses sensed by the first dispense sensor and the beverage order data. The controller is configured to selectively control each light in the plurality of lights such that the plurality of lights indicates the remaining number of cup dispenses to the user. The controller is configured to calculate the remaining number of cup dispenses based on a difference between the cup dispenses sensed by the dispense sensor and a number of beverages in the beverage order data.

In certain examples, a food product dispensing machine comprises a cup holder configured to hold the cup, a first sensor that is configured to sense an attribute of the cup, and a controller that is configured to determine presence of a cup and/or a size of the cup based on the attribute of the cup.

BRIEF DESCRIPTION OF THE DRAWINGS

Examples are described with reference to the following drawing FIGURES. The same numbers are used throughout the FIGURES to reference like features and components.

DETAILED DESCRIPTION OF THE DRAWINGS

The present disclosure provides examples of food product dispensing machines that dispense a food product into a cup. The dispensing machines can include cup holders that move one or more cups from a staging position to a dispensing position where the cups are filled with the food product. The dispensing machine can be useful in high quantity food vending applications such as restaurants where multiple cups are quickly filled.

Figure 1:
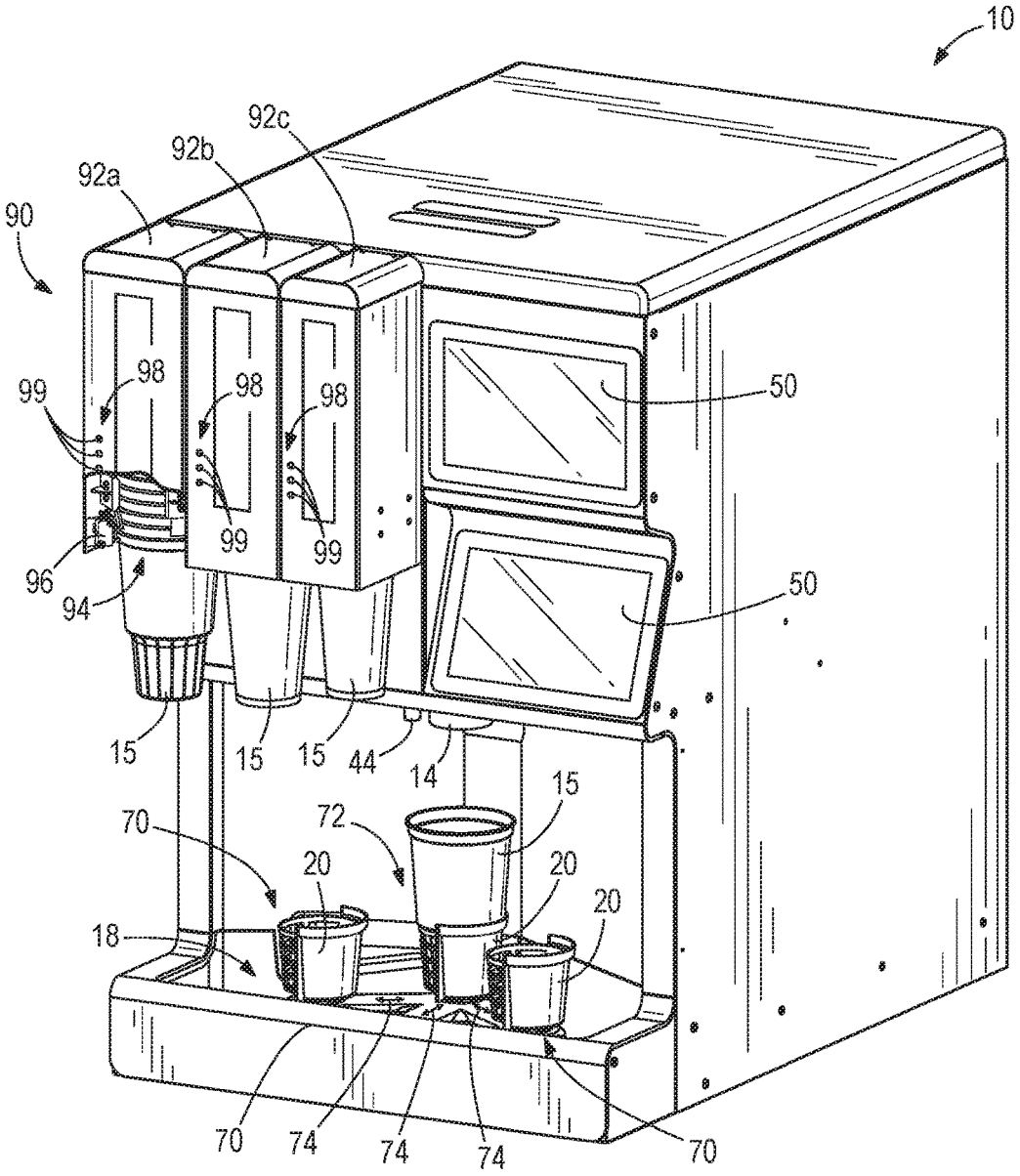
FIG. 1 is an example dispensing machine.
Figure 2:
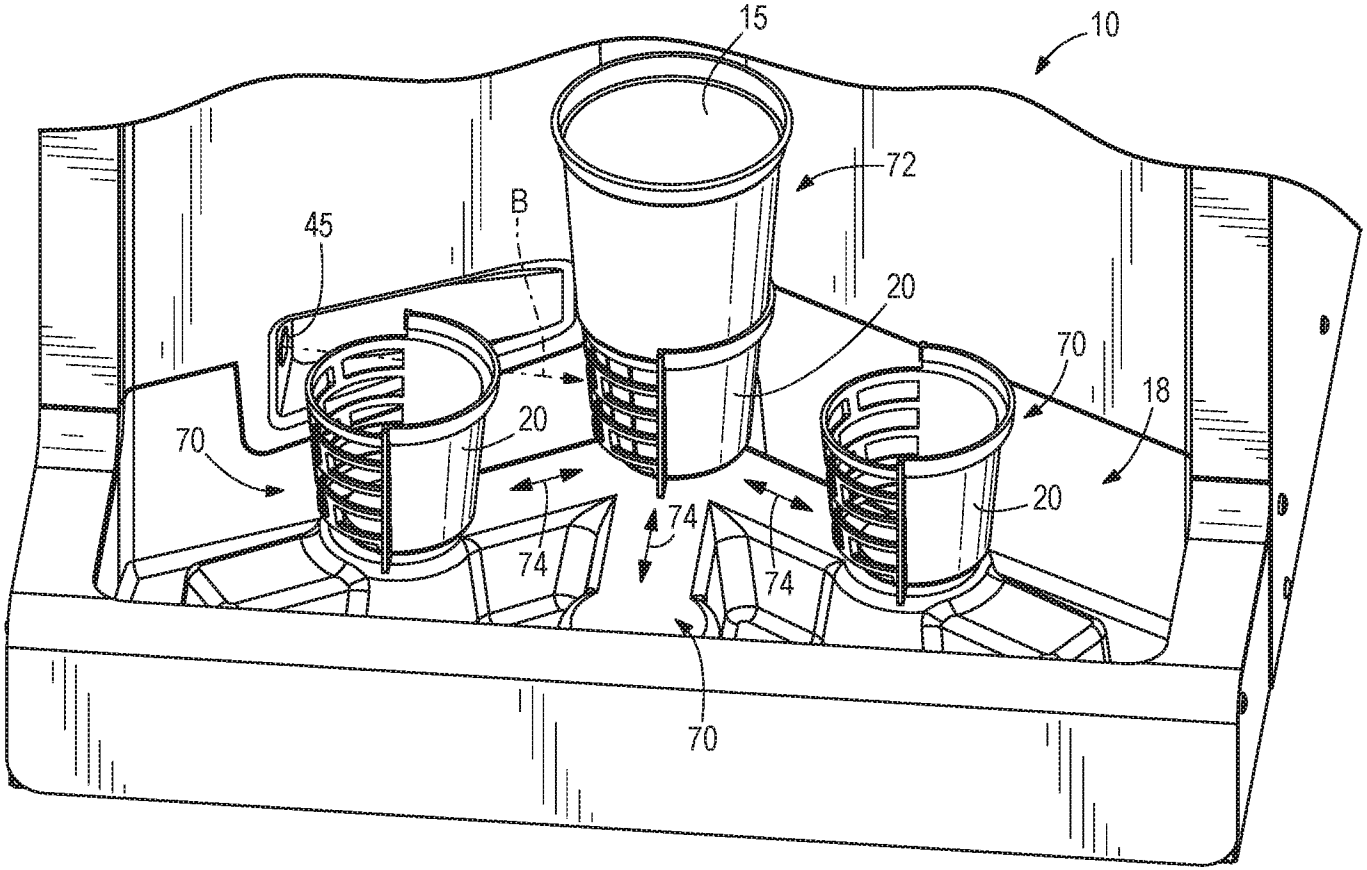
FIG. 2 is an enlarged view of a deck of the dispensing machine of FIG. 1.

Referring to FIGS. 1-2, the dispensing machine 10 includes a cup dispenser 90 having one or more cup housings 92*a*-92*c* for storing stacks of cups 15 having different sizes. Each cup housing 92*a*-92*c* has an outlet 94 from which the user or operator can manually dispense the cups 15. A dispense sensor 96 and/or an indicator 98 are coupled to each of the cup housings 92*a*-92*c*. To dispense a cup 15, the user pulls on the lowermost cup 15 of the stack of cups. The dispense sensor 96 senses when the cup 15 is dispensed through the outlet 94. The indicator 98 is coupled to the cup housing (see respective cup housings 92*a*-92*c*) and is configured to indicate to the user a remaining number of cup dispenses (i.e. the remaining number of cup dispenses is the number of cups 15 still yet to be dispensed from the respective cup dispenser 90, and more particularly from the respective cup housings 92*a*-92*c*). The indicator 98 can include a display panel and/or a plurality of lights 99. In one non-limiting example, a first dispense sensor 96 is coupled to a first cup housing 92*a* and senses cups 15 dispensed through a first outlet 94; a second dispense sensor (not shown) is coupled to a second cup housing 92*b* and senses cups 15 dispensed through a second outlet 94; and a third dispense sensor (not shown) is coupled to a third cup housing 92*c* and senses cups 15 dispensed through a third outlet 94.

Each cup 15 that is dispensed from the cup dispenser 90 can be received in one of a plurality of cup holders 20 (see also FIGS. 3-4) which are removably coupled to the dispensing machine 10, as will be further explained herein below. Each cup holder 20 is supported on a deck 18 and is movable along an associated radial path 74 on the deck 18. Each radial path 74 is a straight line path. The respective radial paths 74 are radially spaced apart from each other. Each radial path 74 ends at a staging position 70 where the user places the cup in the cup holder 20 and a dispensing position 72 where the cup 15 receives food product from the food product dispenser 14. (see also FIGS. 1 and 7). The dispensing position 72 is radially inwardly from the staging positions 70, and the staging positions 70 form an arc about the dispensing position 72. In the illustrated example, the dispensing position 72 is common for all cup holders 20.

Figure 4:
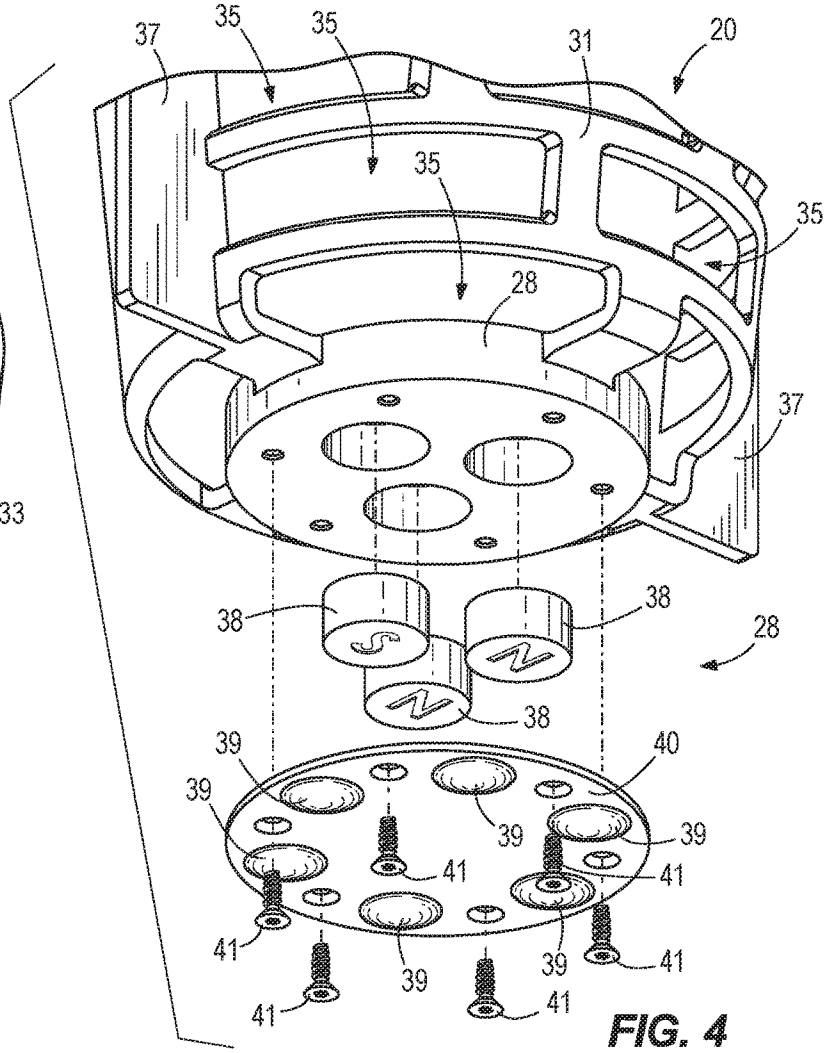
FIG. 4 is an exploded view of the cup holder of FIG. 3.
Figure 3:
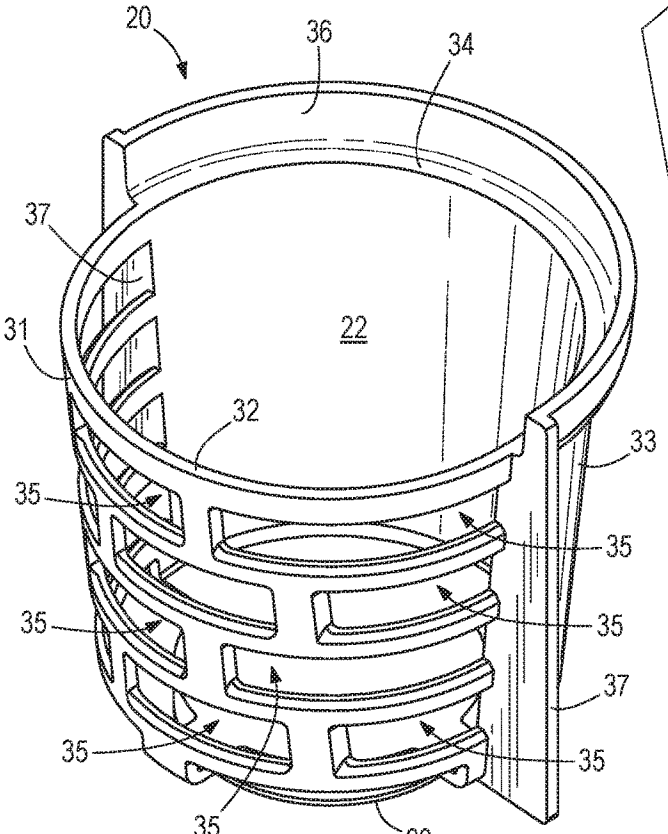
FIG. 3 is an example cup holder.

Referring to FIGS. 3-4, the cup holder 20 includes a base 28, a front sidewall 31, a rear sidewall 33, and a target element 22. The base 28 supports the cup 15 when the cup 15 is received by the cup holder 20. The sidewalls 31, 33 are coupled to the base 28 and extend axially away from the base 28 such that the front sidewall 31 is radially opposite the rear sidewall 33. A top portion 32 of the front sidewall 31 and a top portion 34 of the rear sidewall 33 are on opposite sides of the cup 15 when the cup 15 is supported by the cup holder 20. The front sidewall 31 defines an opening 35. The target element 22 is coupled to or partially formed in the rear sidewall 33. The front sidewall 31 and/or the rear sidewall 33 slope radially away from the base 28. In some examples, a radially projecting top edge 36 and/or radially projecting side elements 37 are coupled to the front sidewall 31 and/or the rear sidewall 33. In other examples, the sidewalls 31, 33 include a plurality of spaced-apart openings 35.

The cup holder 20 includes a plate 40 that is coupled to the base 28 by fasteners 41. The plate 40 retains at least one driven magnet 38 in the base 28. The plate 40 can include one or more protrusions 39 that are configured to contact the deck 18 and reduce friction between the cup holder 20 and the deck 18 as the cup holder 20 is moved along the deck 18 (see FIG. 7). The plate 40 can retain a second and/or third driven magnets 38 in the base 28 of the cup holder 20. The second and third driven magnets 38 have polarities that are opposite the first driven magnet 38 (see FIG. 4 depicting the first, second, and third driven magnets 38 with different polarities, respectively, where the letter "S" is for south and "N" is for north). The protrusions 36 can be semi-spherical in shape.

Figure 5:
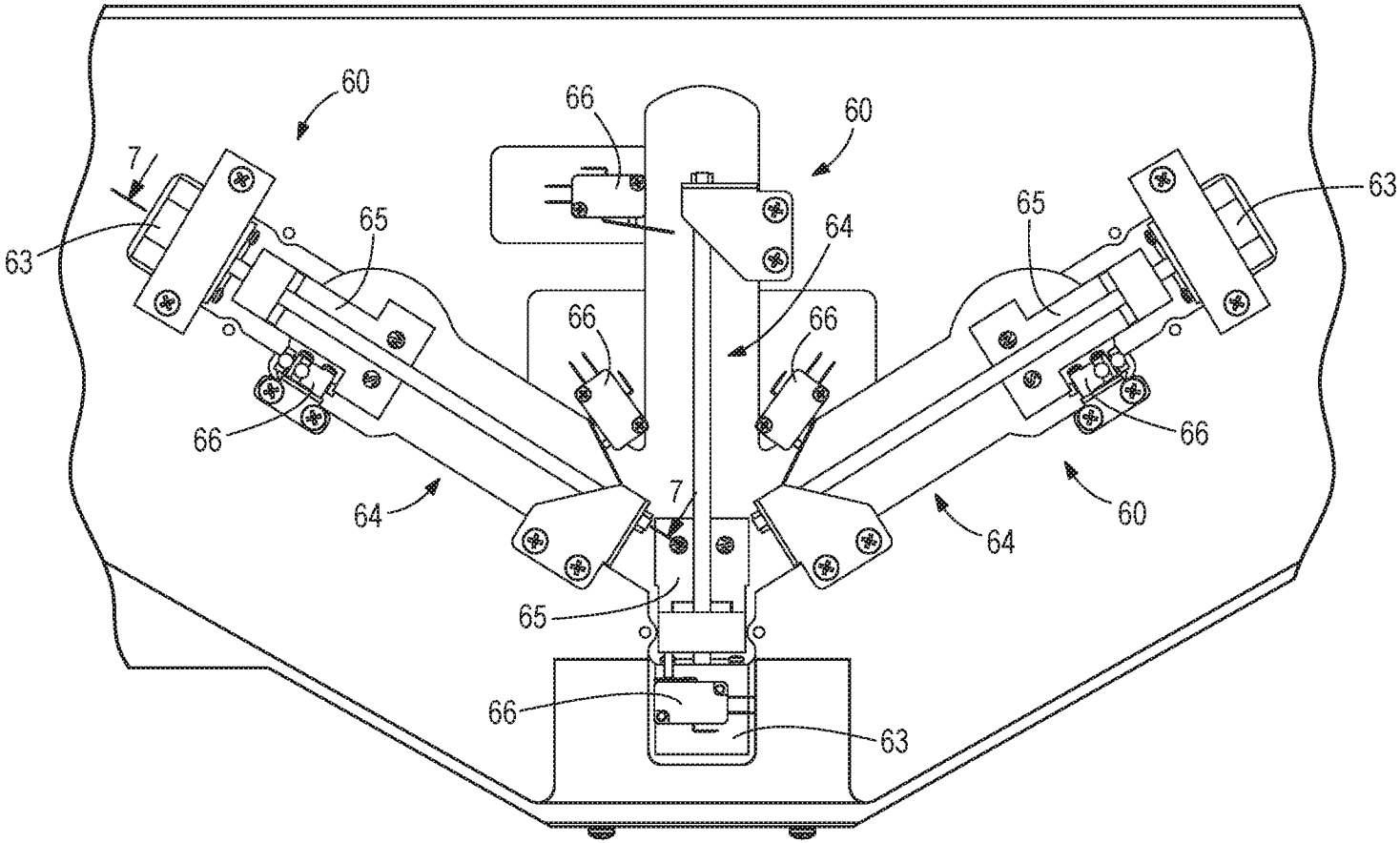
FIG. 5 is a bottom view of the deck of FIG. 2.
Figure 6:
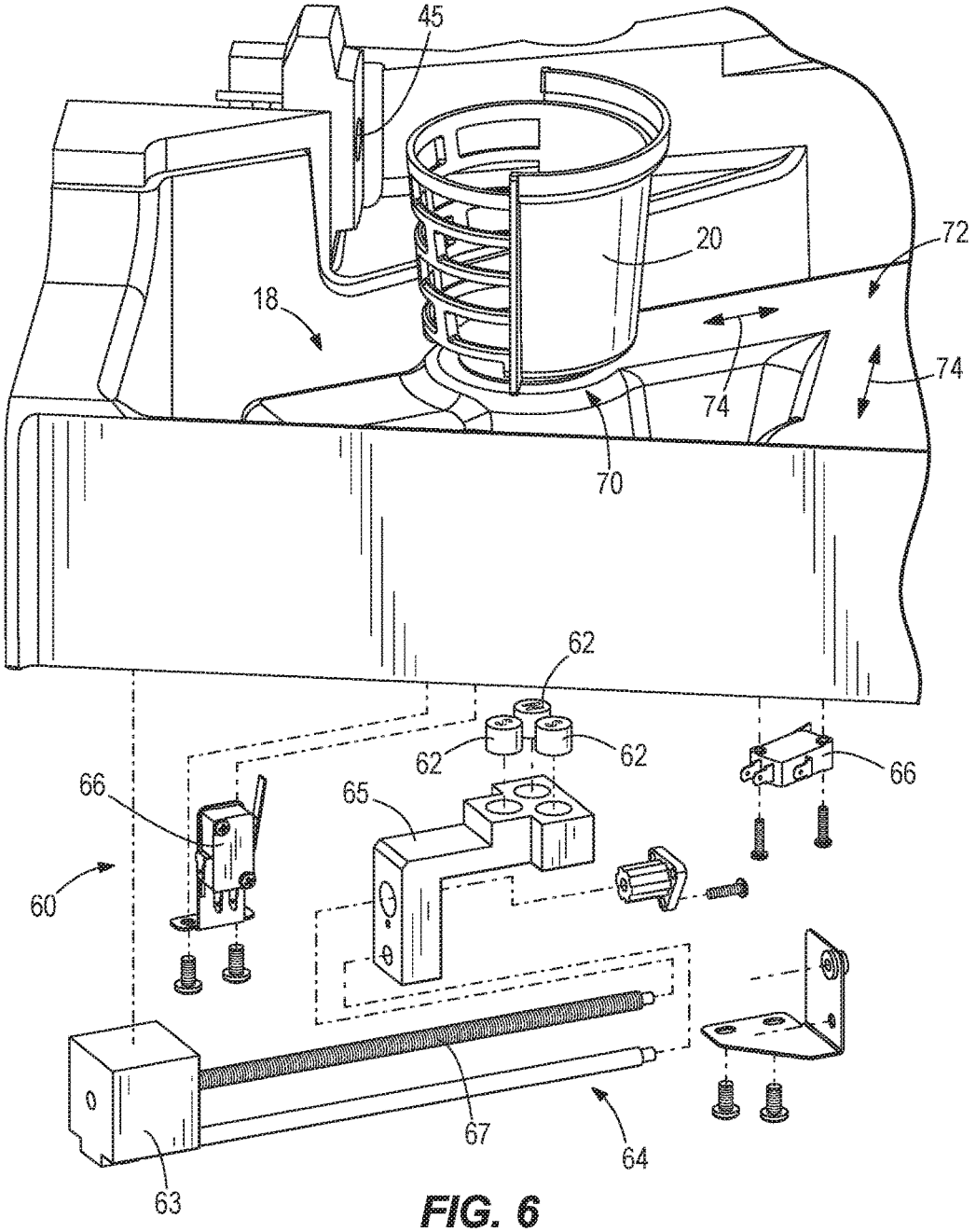
FIG. 6 is an exploded view of a drive mechanism.
Figure 7:
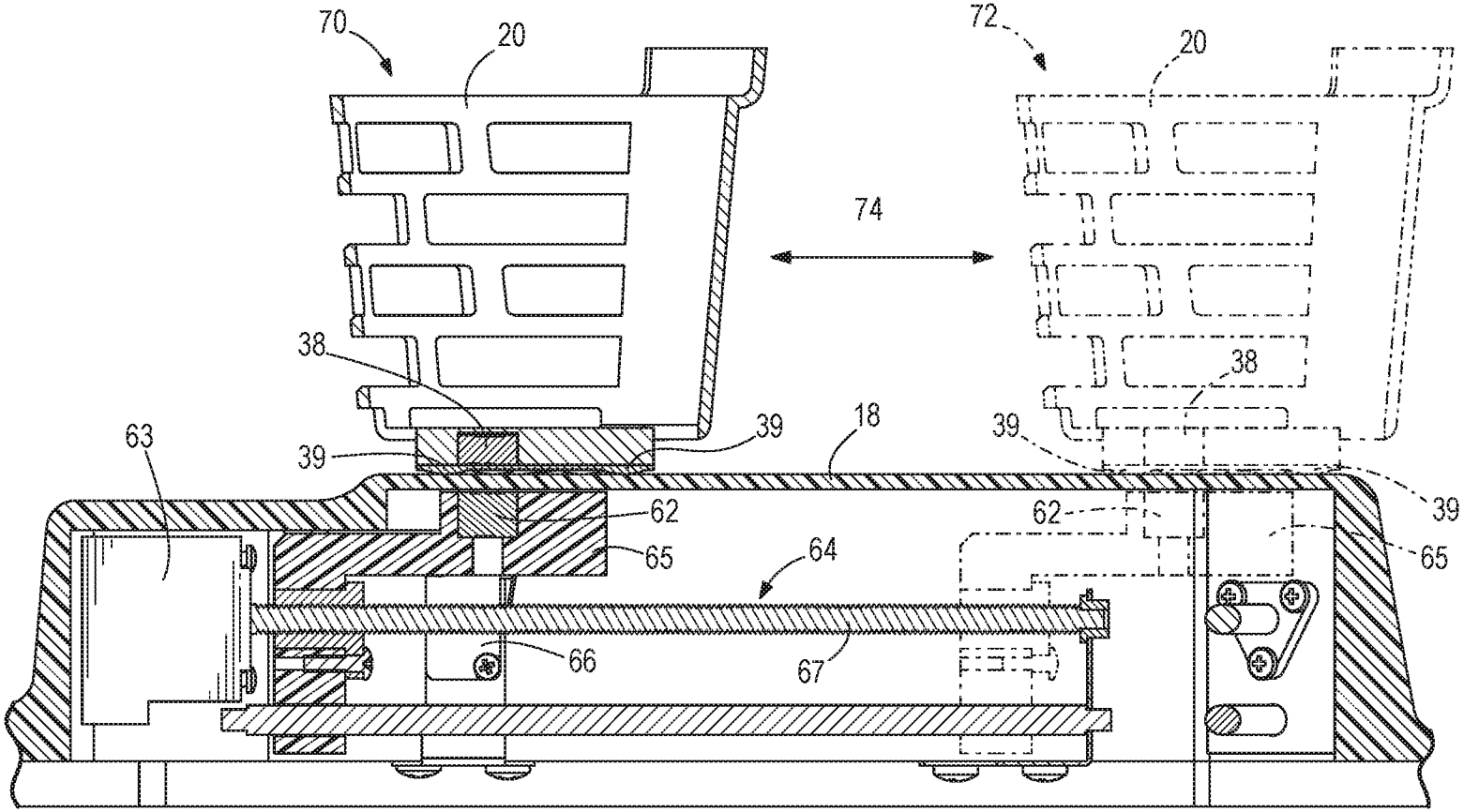
FIG. 7 is cross-sectional view of the deck of FIG. 2 along 7-7 of FIG. 5, showing a cup holder in a staging position (solid lines) and a dispensing position (dashed lines).

Referring to FIGS. 5-7, drive mechanisms 60 are positioned below the deck 18 and are configured to magnetically couple with the cup holders 20, as described further herein below. Each drive mechanism 60 moves a respective cup holder 20 along an associated radial path 74 between the staging position 70 and the dispensing position 72. In the illustrated example, each drive mechanism 60 includes a drive motor 63, a lead screw assembly 64, a drive body 65, and a limit switch 66. The drive body 65 is connected to a lead screw 67 of the lead screw assembly 64. The drive motor 63, which is connected to a power source 130 (see FIG. 8), is configured to rotate the lead screw 67 such that the drive body 65 moves toward the dispensing position 72. The drive motor 63 is also configured to rotate the lead screw 67 in an opposite direction such that the drive body 65 moves toward the staging position 70. The limit switch 66 can turn off power to the drive motor 63 when the drive body 65 contacts the limit switch 66.

The drive body 65 carries a driving magnet 62 which magnetically couples to driven magnets 38 when the cup holder 20 is placed on or adjacent to the deck 18. In FIG. 7, the driving magnet 62 is magnetically coupled to the driven magnet 38 and the cup holder 20 is in the staging position 70 (the cup holder 20 is shown in solid lines while in the staging position 70). As the drive motor 63 rotates the lead screw 67, the drive body 65 and the cup holder 20 are caused to move along the radial path 74 toward the dispensing position 72 (the cup holder 20 is shown in dashed lines while in the dispensing position 72). The drive body 65 can include a second and/or third driving magnet 62 that have polarities that are opposite the first driving magnet 62 (see FIG. 6 depicting the first, second, and third driving magnets 62, wherein the letter "S" is for south and "N" is for north). In one example, the first driven magnet 38 magnetically couples to the first driving magnet 62, the second driven magnet 38 magnetically couples to the second driving magnet 62, and the third driven magnet 38 magnetically couples to the third driving magnet 62. Thus, the driven magnets 38 are configured to magnetically couple with the driving magnets 62 and cause the cup holder 20 to rotate, "clock" into a predetermined orientation and/or automatically align with the drive mechanism 60 and/or the driving magnets 62, due to the polarities of the magnets 38, 62. For example, when the cup holder 20 is moved toward the driving magnets 62, the driving magnets 62 with north polarities resist the driven magnets 38 with north polarities and the driving magnets 62 with south polarities attract to the driven magnets 38 with north polarities, thus causing the cup holder 20 to rotate or "clock" to the predetermined orientation such that the driving magnets 62 with the north polarities are positioned close to the driven magnets 38 with south polarities and the driving magnets 62 with south polarities are positioned close to the driven magnets 38 with north polarities. In some examples, the first, second, and third driving magnets 62 can form a triangular shape.

Figure 8:
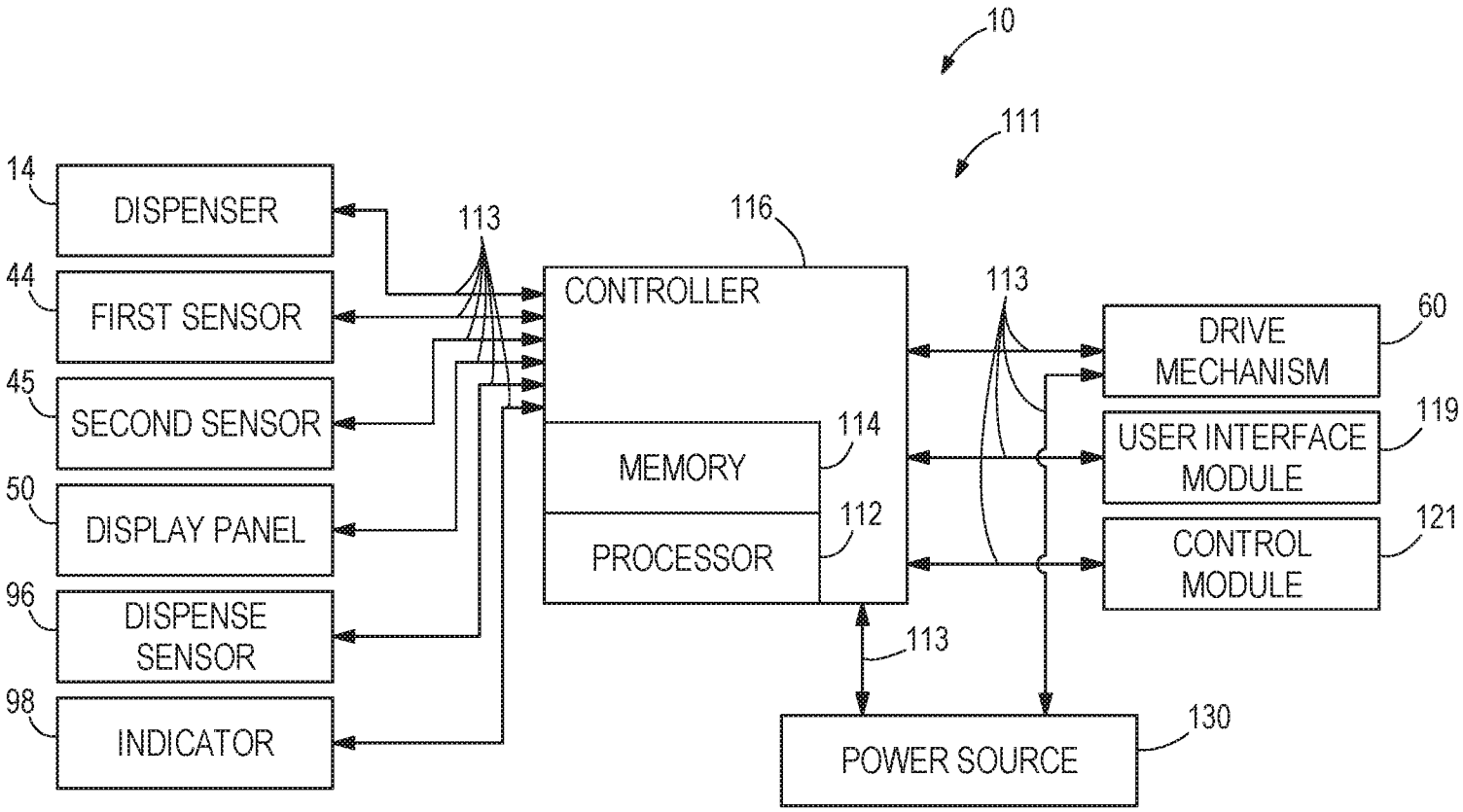
FIG. 8 is an example system diagram.

Referring to FIG. 8, the dispensing machine 10 can be part of and controlled by a system 111. The system 111 can include a computer controller 116 that is programmable and includes a processor 112 and a memory 114. The controller 116 can be located with or remotely from the system 111 and can communicate with various components of the dispensing machine via wired and/or wireless links, as will be explained further herein below. Although FIG. 8 shows a single controller 116, the system 111 can include more than one controller 116. Portions of the methods described herein can be carried out by a single controller or by several separate controllers. Each controller 116 can have one or more control sections or control units. One having ordinary skill in the art will recognize that the controller 116 can have many different forms and is not limited to the example that is shown and described.

In some examples, the controller 116 can include a computing system that includes a processing system, storage system, software, and input/output (I/O) interfaces for communicating with devices described herein. The processing system loads and executes software from the storage system, such as software programmed with a display and moving control method. When executed by the computing system, display software directs the processing system to operate as described herein to execute image display or notification on a display panel 50 such as light illumination, light colors, audible sounds, and/or vibrations. In another example, when executed by the computing system, movement software directs the processing system to operate the drive mechanisms 60 described herein to execute movement of the cup holders 20 on the deck 18 (see FIG. 7).

The computing system may include one or many application modules and one or more processors, which may be communicatively connected. The processing system may comprise a microprocessor (e.g., processor 112) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 114) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. The storage media can be a non-transitory or a transitory storage media.

In the illustrated example, the controller 116 communicates with one or more components of the system 111 via communication links 113, which can be wired or wireless links. The controller 116 is capable of monitoring and controlling one or more operational characteristics of the system 111 and its various subsystems by sending and receiving control signals via the communication links 113. It should be noted that the extent of connections of the communication links 113 shown herein is for schematic purposes only, and the communication links 113 provide communication between the controller 116 and each of the sensors, devices, and various subsystems described herein, although not every connection is shown in the drawing for purposes of clarity. The controller 116 can control the display panels 50, and the controller 116 may coordinate display information on multiple display panels 50.

The system 111 can include several modules. A user interface module 119 can allow the user or operator to control the dispenser 14 and/or fluid valves (not shown). For example, the user may interact with the display panel 50 (see FIG. 1) to select a beverage and/or flavors, activate the dispenser 14, and/or activate the drive mechanism 60. The user interface module 119 may be connected to a remote (not shown), a control panel, a connection port, an existing point-of-service computer network, and/or the like. A control module 121 such as an internet or network module can connect the dispensing machine 10 to the internet. The control module 121 may also send beverage data to the user interface module 119. The control module 121 can be wireless or wired, and the control module 121 can allow a remote user to control the components of the dispensing machine 10.

Referring to FIGS. 5-7, the drive mechanisms 60 are controlled by the controller 116 (see FIG. 8). For example, the controller 116 can regulate power from the power source 130 to the drive mechanisms 60 (see FIG. 8).

Referring to FIG. 1, the dispensing machine 10 includes a first sensor 44 that senses presence and/or an attribute of the cup 15 in a cup holder 20 and sends a signal related to what is sensed to the controller 116 (see FIG. 8). The controller 116 is configured to determine if a cup 15 is received by the cup holder 20 and/or verify the size of the cup 15 received by the cup holder 20. Based on the size of the cup 15 determined by the controller 116, the controller 116 is configured to activate the drive mechanism 60 to move the cup holder 20 to the dispensing position 72 and/or activate the dispenser 14 to dispense an amount of food product corresponding to the size of the cup 15. The first sensor 44 can concurrently detect the presence of cups 15 in all cup holders 20. Alternatively, the first sensor 44 can sense the presence of a cup 15 in a single cup holder 20, such as a cup holder 20 positioned at the dispensing position 72. The first sensor 44 senses the diameter of the cup 15 or any other attribute of the cup 15 (i.e. depth, circumference). The features described above, and later herein, expedite filling of cups 15 and increase the output of filled cups 15 from the dispensing machine 10 (e.g. activation of the drive mechanism 60 as soon as the presence and/or size of the cup 15 is determined decreases the amount of time a cup 15 remains unfilled).

Referring to FIG. 2, the dispensing machine 10 can include a second sensor 45 that senses the target element 22 (see FIGS. 2-3). The second sensor 45 can sense in a direction B which is orientated toward the dispensing position 72. When the cup holder 20 is in the dispensing position 72, the second sensor 45 senses the target element 22 and sends a signal related to what is sensed to the controller 116 (see FIG. 8). If a cup 15 is in the cup holder 20, the second sensor 45 cannot sense portions of the target element 22 that are blocked by the cup 15. As explained further herein below, the controller 116 can be configured to interpret the signal from the second sensor 45 and determine if there is a cup 15 in the cup holder 20 and if so, the size of the cup 15 in the cup holder 20. Based on the size of the cup 15 determined by the controller 116, the controller 116 activates the dispenser 14 to dispense an amount of food product corresponding to the size of the cup 15 to thereby adequately fill, without overfilling, the cup 15 in the cup holder 20 at the dispensing position 72. The sensors 44, 45 can be proximity sensors, cameras, light sensors, ultrasonic sensors, and/or the like.

In some examples, the controller 116 interprets the remaining portion of the target element 22 (e.g. the surface area of the target element 22 not blocked by the cup 15 while the cup 15 is in the cup holder 20) sensed by the second sensor 45 to thereby determine the size of the cup 15. The signal relayed by the second sensor 45 to the controller 116 can be an image of the target element 22, data related to the amount of light reflecting from the target element 22, and/or the like. The controller 116 can be configured to communicate with a memory 114 that stores a plurality of target element 22 surface area values (such as in a look-up table) that are correlated to sizes of the cups 15, such as small, medium, and/or large. The controller 116 can be configured to compare the surface area of the remaining portion of the target element 22 sensed by the second sensor 45 to the plurality of area values in the memory 114 to thereby determine the size of the cup 15. The controller 116 can account for the portions of the target element 22 blocked by the front sidewall 31.

Figure 10:
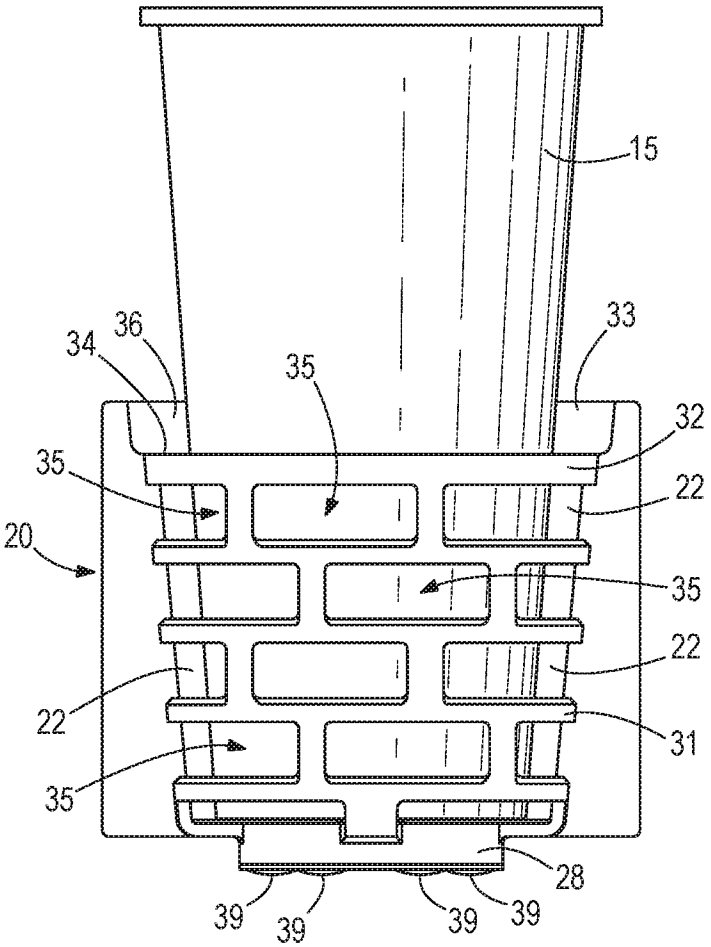
FIG. 10 is a side view of the cup holder of FIG. 3 with a small cup.
Figure 9:
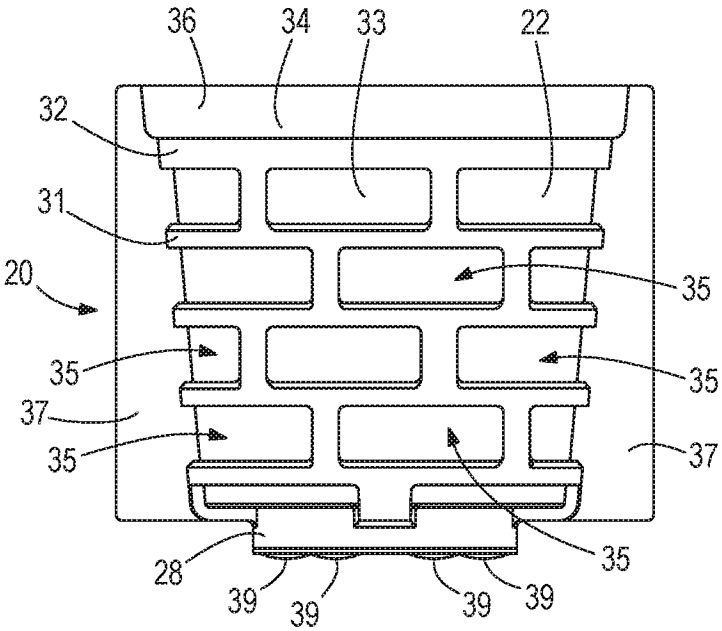
FIG. 9 is a side view of the cup holder of FIG. 3 without a cup.
Figure 12:
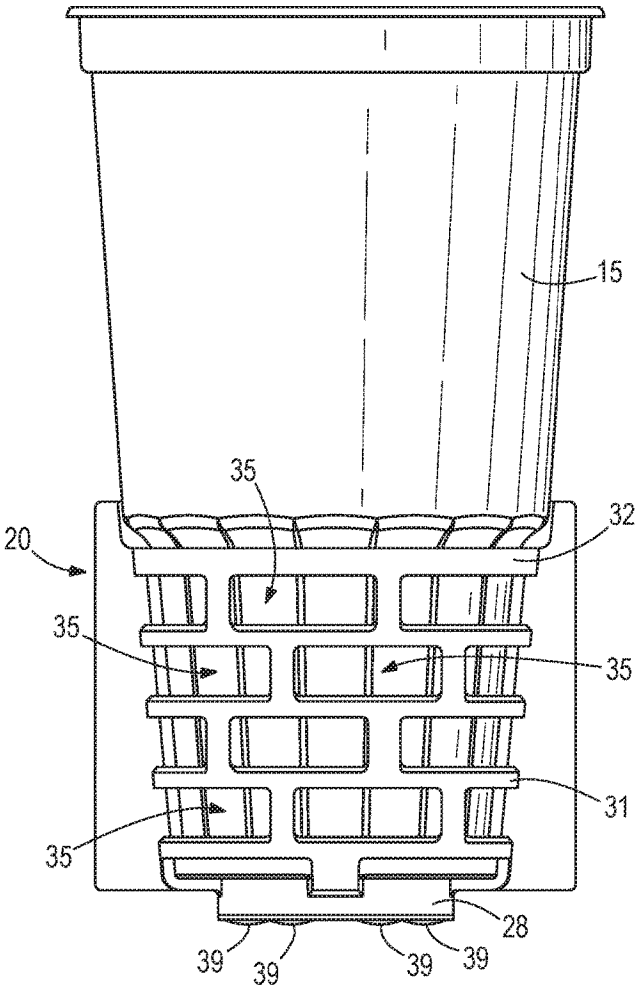
FIG. 12 is a side view of the cup holder of FIG. 3 with a large cup.
Figure 11:
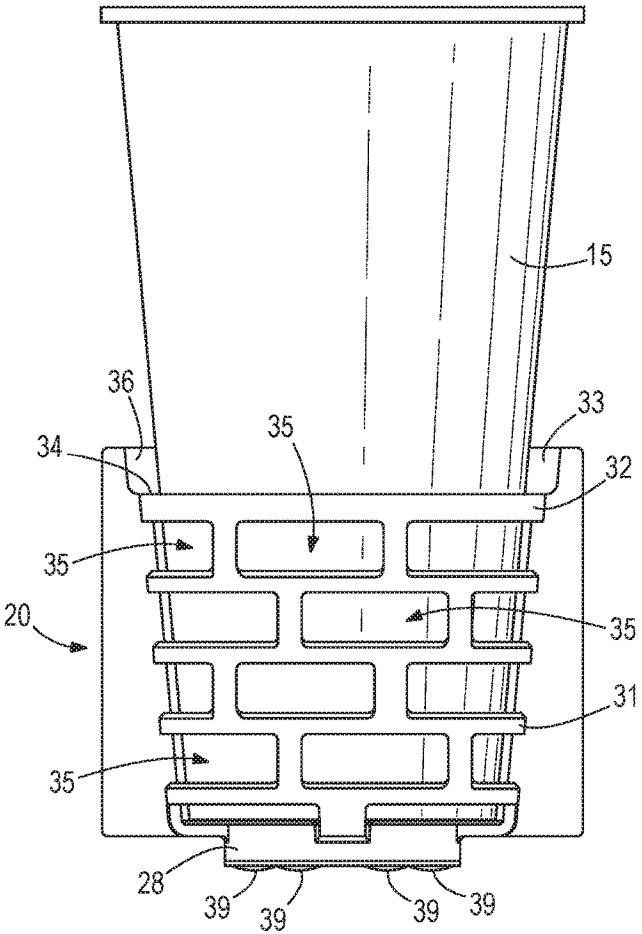
FIG. 11 is a side view of the cup holder of FIG. 3 with a medium cup.

Referring to FIGS. 9-12, several views of the cup holder 20 without and with cups 15 are shown. In FIG. 9, the cup holder 20 is depicted without a cup 15, the second sensor 45 senses most portions of the target element 22 through openings 35 in the front sidewall 31. In FIG. 10, a small cup 15 is supported by the cup holder 20 such that the second sensor 45 senses remaining portions of the target element 22 near the top portion 34 of the rear sidewall 33 and the sides of the cup 15. In FIG. 11, a medium cup 15 is supported by the cup holder 20 such that the second sensor 45 senses remaining portions of the target element 22 near the top portion 34 of the rear sidewall 33 (i.e. the remaining portions of the target element 22 are relatively smaller when compared to the remaining portions of the target element 22 when a small cup 15 is supported by the cup holder 20). In FIG. 12, a large cup 15 is supported by the cup holder 20 such that the second sensor 45 does not sense the target element 22 because the large cup 15 obstructs all portions of the target element 22 from being sensed by the second sensor 45.

In certain examples, the cup 15 need not be aligned in the center of the cup holder 20 for the second sensor 45 to correctly sense of the target element 22 or for the controller 116 to correctly determine of the size of the cup 15. For example, the controller 116 can determine the size of the cup 15 in the cup holder 20 based on a cumulative area of the remaining portion of the target element 22 sensed by the second sensor 45. Stated another way, if the cup 15 is not centered in the cup holder 20, the second sensor 45 will detect the remaining portion of the target element 22 not blocked by the cup 15 regardless of the division of the remaining portion of the target element 22 such that the controller 116 can determine the size of the cup 15 in the cup holder 20. In other examples, the controller can be configured to determine the size of the cup 15 in the cup holder 20 based on a total number of target elements 22 sensed by the second sensor 45.

The controller 116 can be configured to utilize signals from the first sensor 44, the second sensor 45, and/or the dispense sensor 96 during the operation of the dispensing machine 10 to determine the presence and/or size of the cups 15 in the cup holders 20. In certain examples, the dispense sensor 96 is configured to sense a dispense of a cup 15 from the cup dispenser 90 and send a signal to the controller 116. After the user places the dispensed cup 15 into a cup holder 20, the first sensor 44 senses presence and/or an attribute of the cup 15 in the cup holder 20 and relays a signal to the controller 116, which determines the presence and/or size of the cup 15 (as described above). The drive mechanism 60 then activates to move the cup 15 toward the dispensing position 72, where the second sensor 45 senses the target element 22 of the cup holder 20 (as described above). The second sensor 45 relays a signal (as described above) to the controller 116 which determines and/or verifies the size of the cup 15 in the cup holder 20 at the dispensing position 72. The controller 116 then activates the dispenser 14 which dispenses an amount of food product corresponding to the size of the cup 15. The drive mechanism 60 is then activated to move the cup 15 filled with food product in the cup holder 20 away from the dispensing position 72. In certain examples, the first sensor 44 can be configured to sense the presence of the cup 15 in the cup holder 20 when the cup holder 20 is in the dispensing position 72. The controller 116 can be configured to compare and/or verify the size and/or presence of the cup 15 in the cup holder 20 based on the signals received from the dispense sensor 96, first sensor 44, and/or second sensor 45. Referring to FIGS. 1 and 8, the controller 116 can be configured to control the indicator 98 and/or lights 99. During operation, the controller 116 can be configured to receive beverage data from the control module 121 and to control the indicator 98 based on beverage data and a number of cup dispenses sensed by the dispense sensors 96. The controller 116 can be configured to selectively control each light 99 to indicate the remaining number of cup dispenses to the user from each cup housing 92*a*-92*c*. The controller 116 then calculates the remaining number of cup dispenses based on the difference between a number of cups 15 already dispensed from the cup housings 92*a*-92*c* and sensed by the corresponding dispense sensors 96 and a number of beverages in the beverage data.

Referring to FIGS. 13-21, which are individually discussed herein below, an example dispensing machine 10 includes a plurality of cup holders 20*a*, 20*b*, 20*c*. The first cup holder 20*a* is configured to hold a first cup 15*a*, the second cup holder 20*b* is configured to hold a second cup 15*b*, and the third cup holder 20*c* is configured to hold a third cup 15*c* (see FIG. 21).

As described above, drive mechanisms 60 (see FIG. 6) under the deck 18 are configured to move the cup holders 20*a*, 20*b*, 20*c* along first, second, and third radial paths 74*a*, 74*b*, 74*c*, respectively, on the deck 18 between staging positions 70*a*, 70*b*, 70*c*, respectively, and the common dispensing position 72. The dispenser 14 is positioned inwardly from the staging positions 70*a*, 70*b*, 70*c* and adjacent to the dispensing position 72. For example, a first drive mechanism (see FIG. 5) moves the first cup holder 20*a* on the deck 18 between the first staging position 70*a* where the first cup 15*a* is received in the first cup holder 20*a* and the common dispensing position 72 where the food product is dispensed from the dispenser 14 into the first cup 15*a* (see FIGS. 19-21). Similarly, a second drive mechanism (see FIG. 5) moves the second cup holder 20*b* on the deck 18 between the second staging position 70*b* where the second cup 15*b* is received in the second cup holder 20*b* and the common dispensing position 72 where the food product is dispensed from the dispenser 14 into the second cup 15*b* (see FIGS. 15-17). Still further, a third drive mechanism (see FIG. 5) moves the third cup holder 20*c* on the deck 18 between the third staging position 70*c* where the third cup 15*c* is received in the third cup holder 20*c* and the common dispensing position 72 where the food product is dispensed from the dispenser 14 into the third cup 15*c* (see FIGS. 17-19).

FIGS. 13-21 depict an example operational sequence for the dispensing machine 10. This example includes three cup housing 92*a*, 92*b*, 92*c*.

Figure 13:
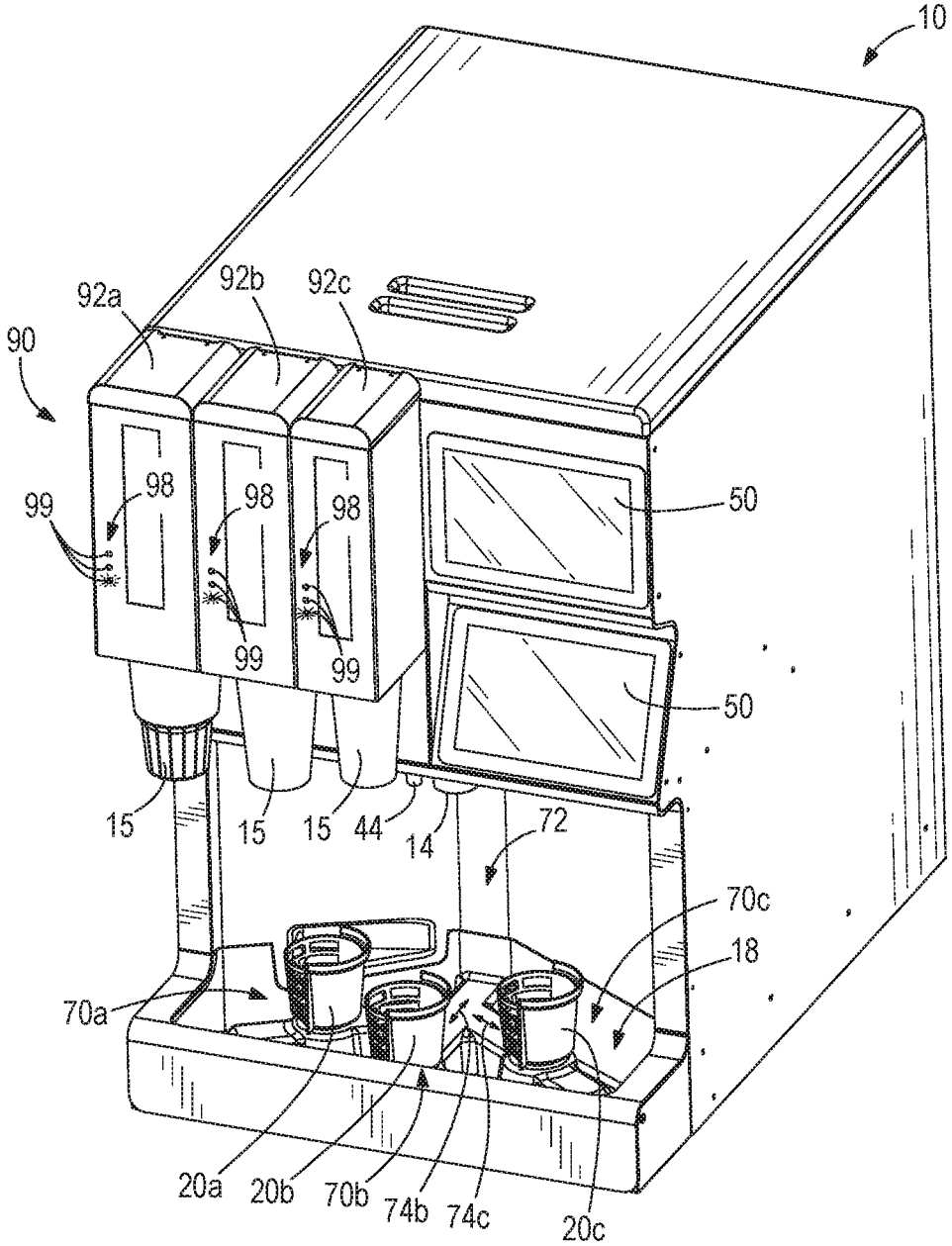
FIGS. 13-21 are perspective views of the dispensing machine during operation.

FIG. 13 depicts a single light 99 on each cup housing 92*a*, 92*b*, 92*c* illuminated by the controller 116 based on the beverage data received by the controller 116. The illuminated lights 99 indicate to the user the number of cups 15 to be manually dispensed from each cup housing 92*a*, 92*b*, 92*c*, respectively. In this example, one cup from each cup housing 92*a*, 92*b*, 92*c* is dispensed by the user.

Figure 14:
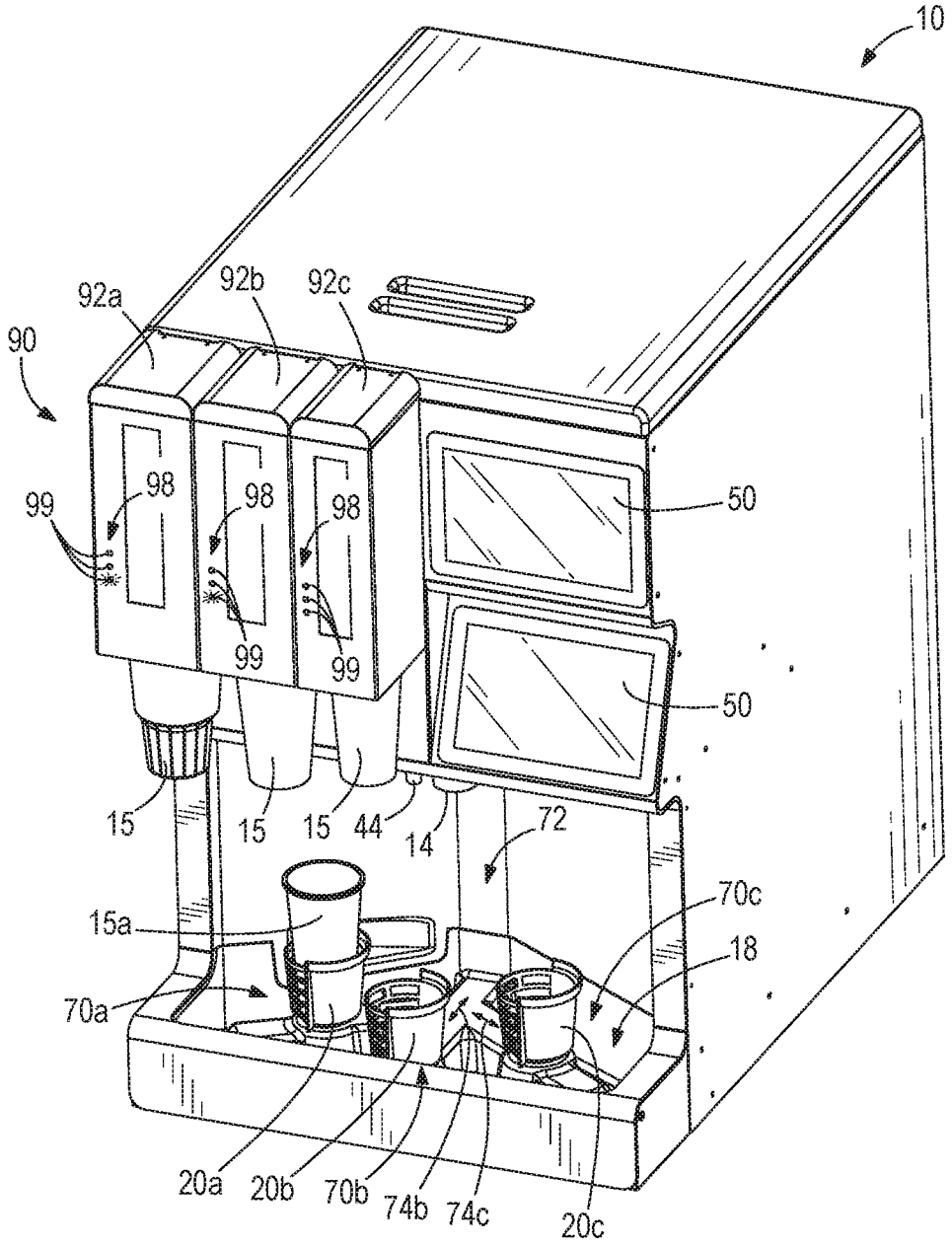

FIG. 14 depicts a cup 15*a* dispensed from the third cup housing 92*c* and placed in the first cup holder 20*a*. Accordingly, the previously illuminated light 99 (see FIG. 13) on the third cup housing 92*c* is turned off by the controller 116 when the third dispense sensor detects the cup 15*a* dispensed from the third cup housing 92*c*. The previously illuminated lights 99 on the first cup housing 92*a* and the second cup housing 92*c* remain illuminated which indicates to the user that one additional cup 15 from the first and second cup housing 92*a*, 92*b* must still be dispensed.

Figure 15:
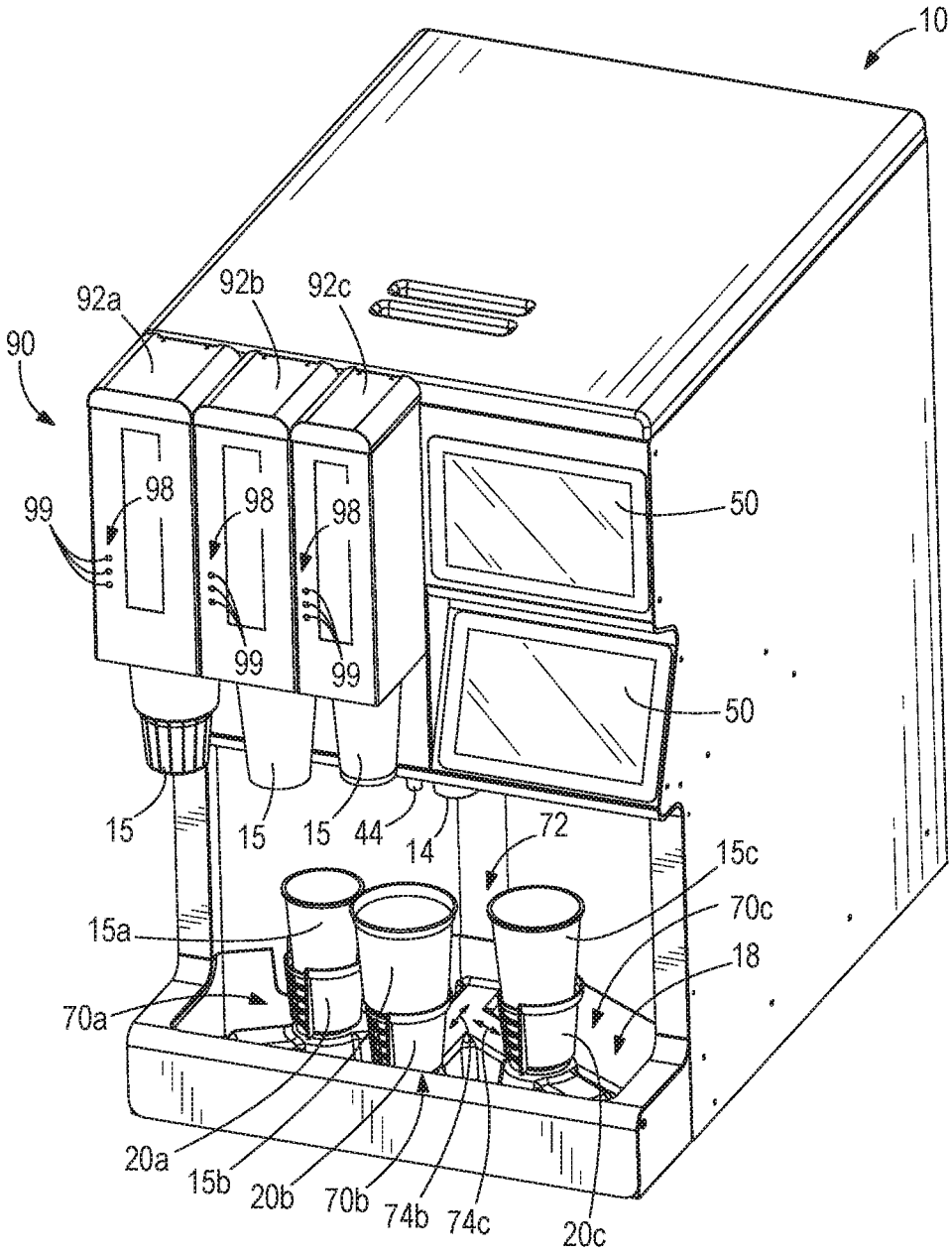

FIG. 15 depicts the cup 15*a* dispensed from the third cup housing 92*c* placed in the first cup holder 20*a* (as described with respect to FIG. 14), the second cup 15*b* from the first cup housing 92*a* placed in the second cup holder 20*b*, and the third cup 15*c* from the second cup housing 92*b* placed in the third cup holder 20*c*. Accordingly, the lights 99 on the cup housing 92*a*, 92*b*, 92*c* are turned off by the controller 116 as the correct cups 15*a*, 15*b*, 15*c* are dispensed from cup housings 92*a*, 92*b*, 92*c*, respectively, and sensed by the dispense sensors 96.

Figure 16:
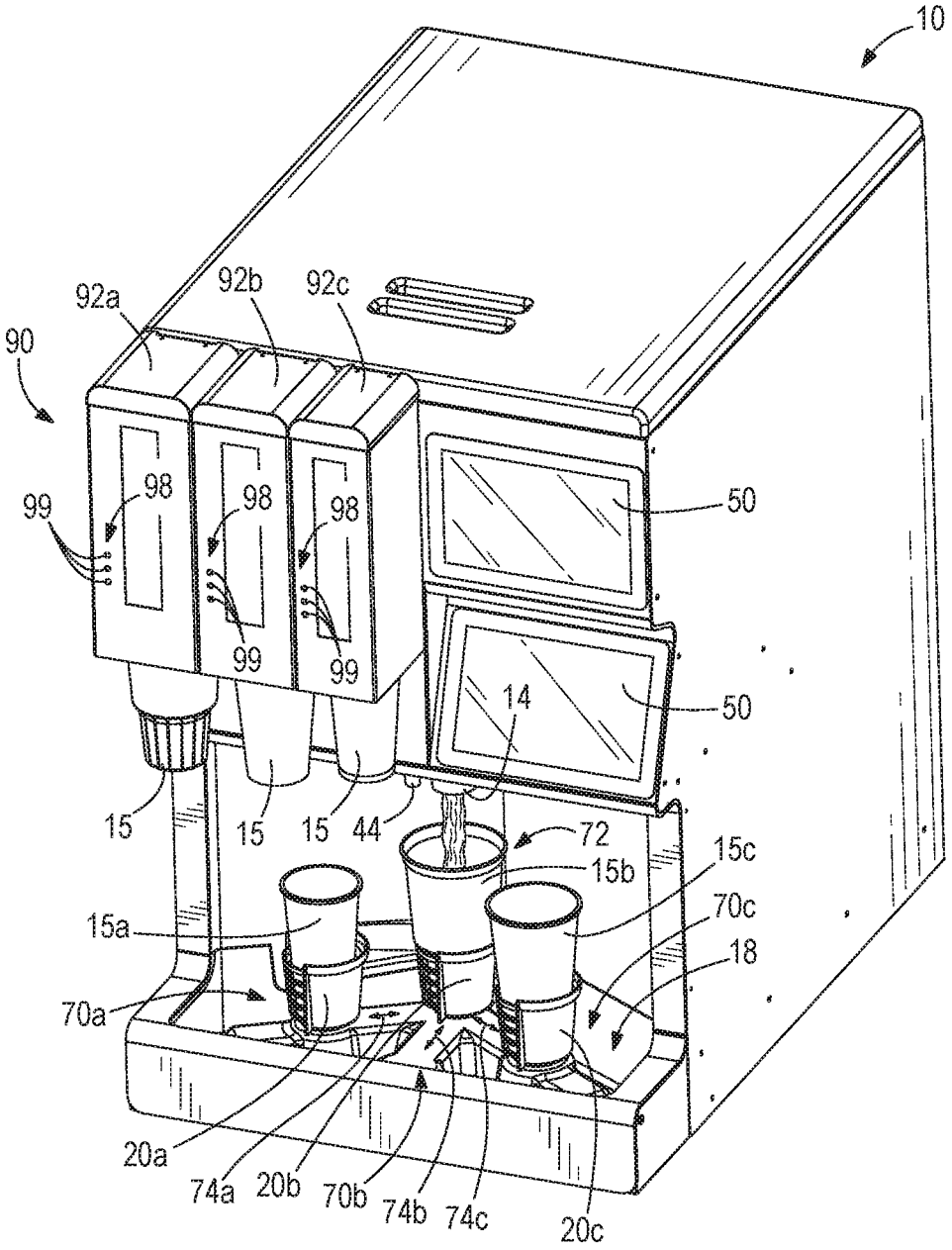

FIG. 16 depicts the second cup holder 20*b* as it is moved along the second radial path 74*b* toward the rear of the dispensing machine 10 from the second staging position 70*b* to the dispensing position 72. In the dispensing position 72, food product is dispensed by the dispenser 14 into the cup 15*b*.

Figure 17:
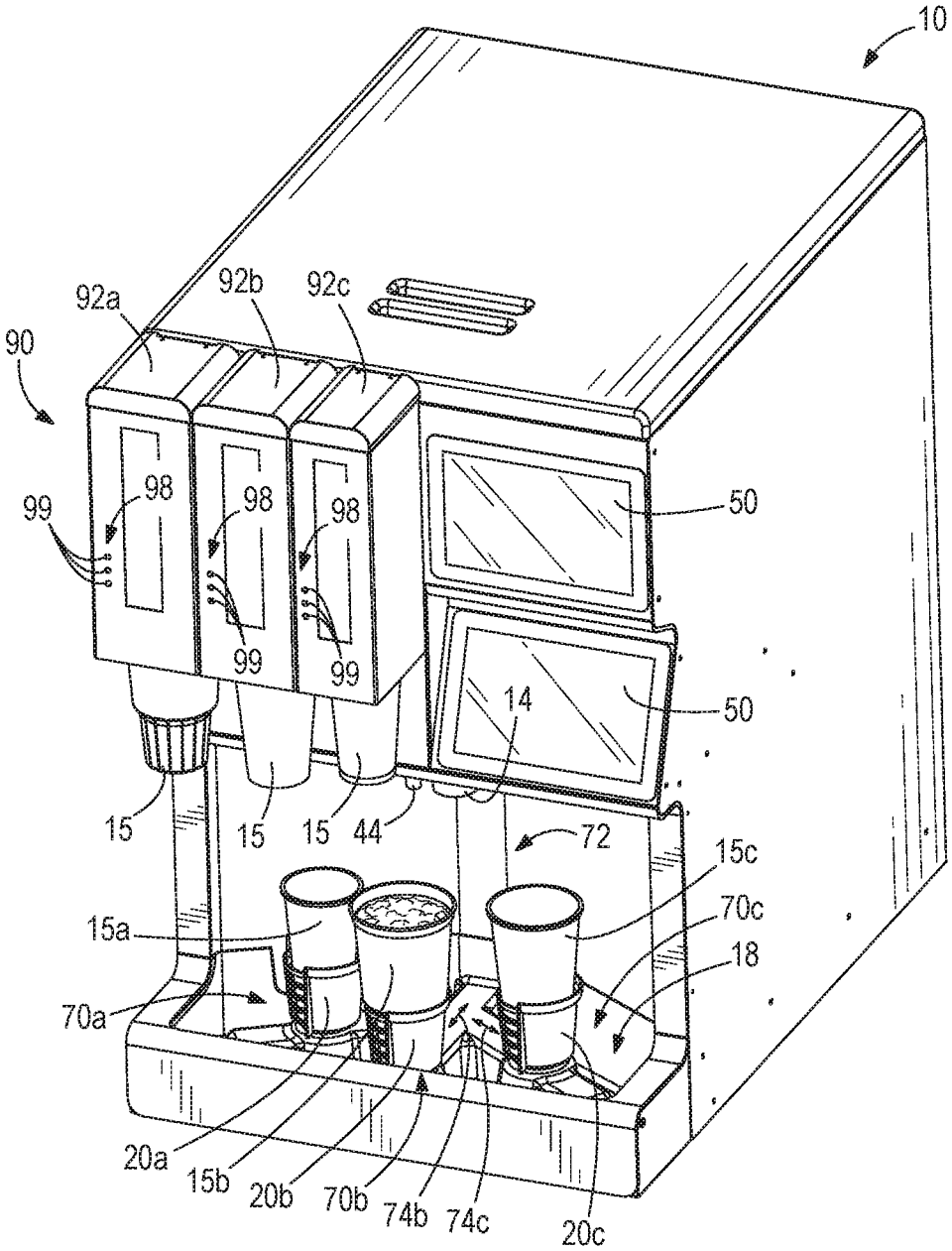

FIG. 17 depicts the second cup holder 20*b* as it is moved along the second radial path 74*b* toward the front of the dispensing machine 10 from the dispensing position 72 to the staging position 70*b*. The user can remove the second cup 15*b* from the cup holder 20*b*.

Figure 18:
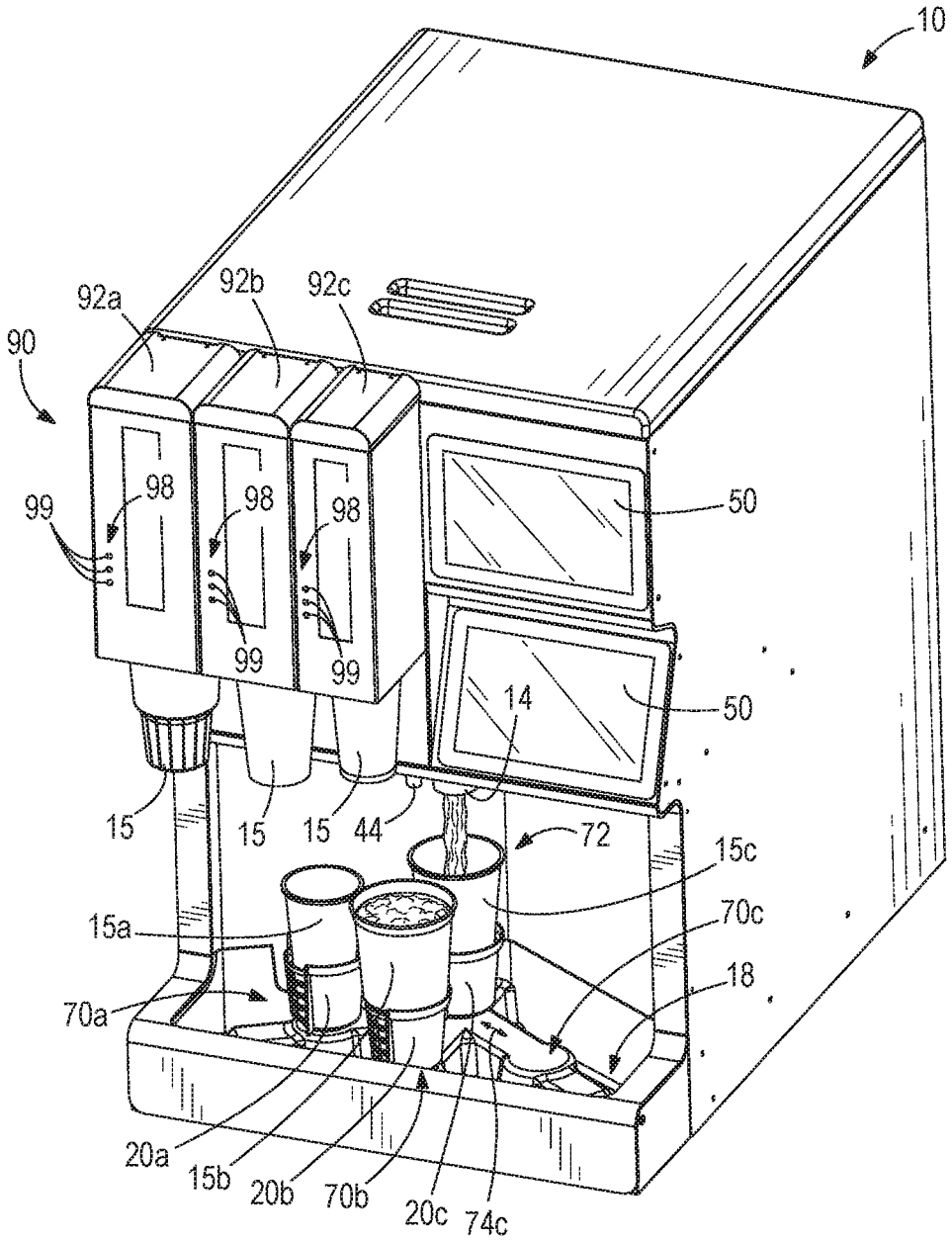

FIG. 18 depicts the third cup holder 20*c* as it is moved along the third radial path 74*c* toward the rear of the dispensing machine 10 from the third staging position 70*c* to the dispensing position 72. In the dispensing position 72, food product is dispensed by the dispenser 14 into the third cup 15*c*.

Figure 19:
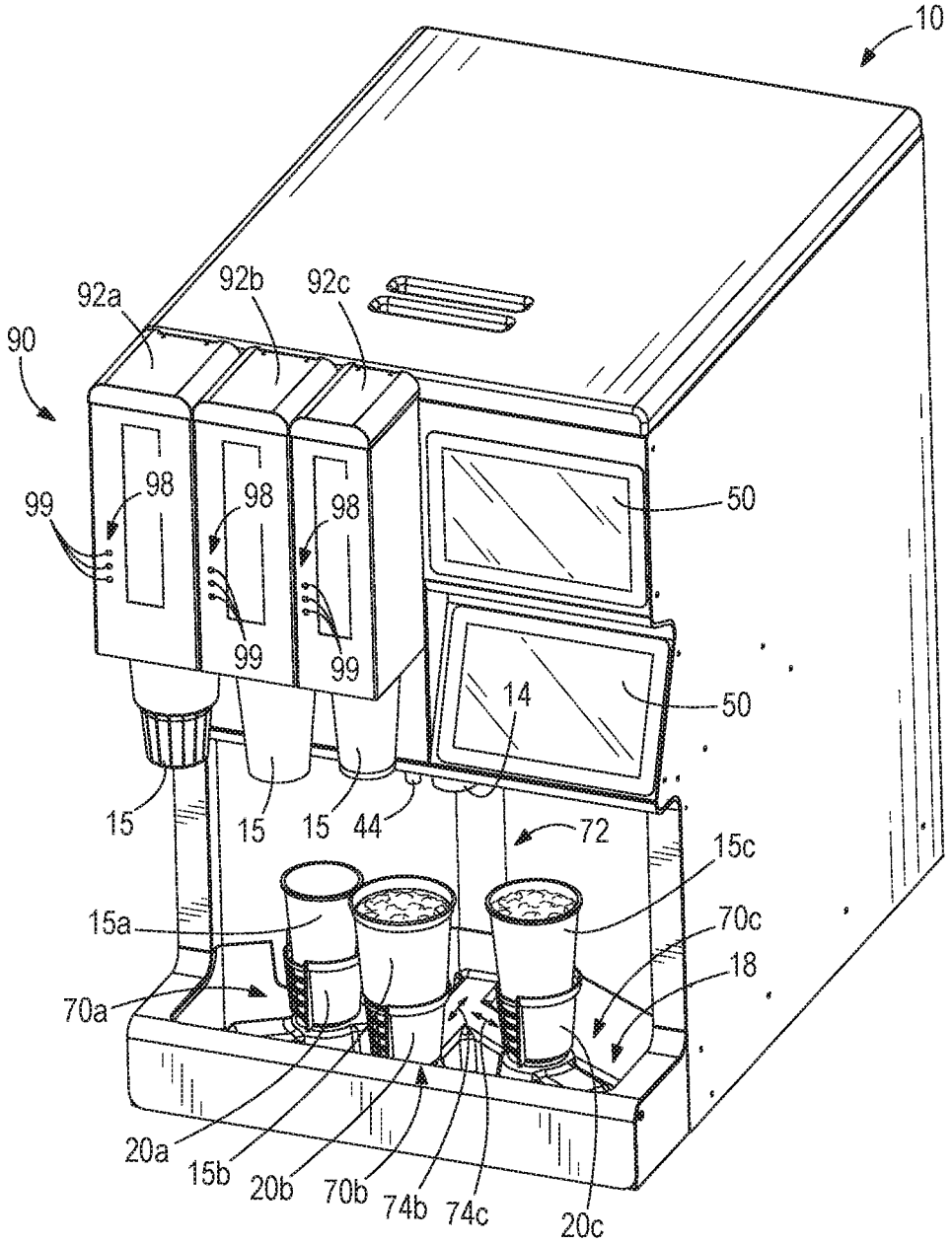

FIG. 19 depicts the third cup holder 20*c* as it is moved along the third radial path 74*c* toward the front of the dispensing machine 10 from the dispensing position 72 to the staging position 70*c*. The user can remove the third cup 15*c* from the cup holder 20*c*.

Figure 20:
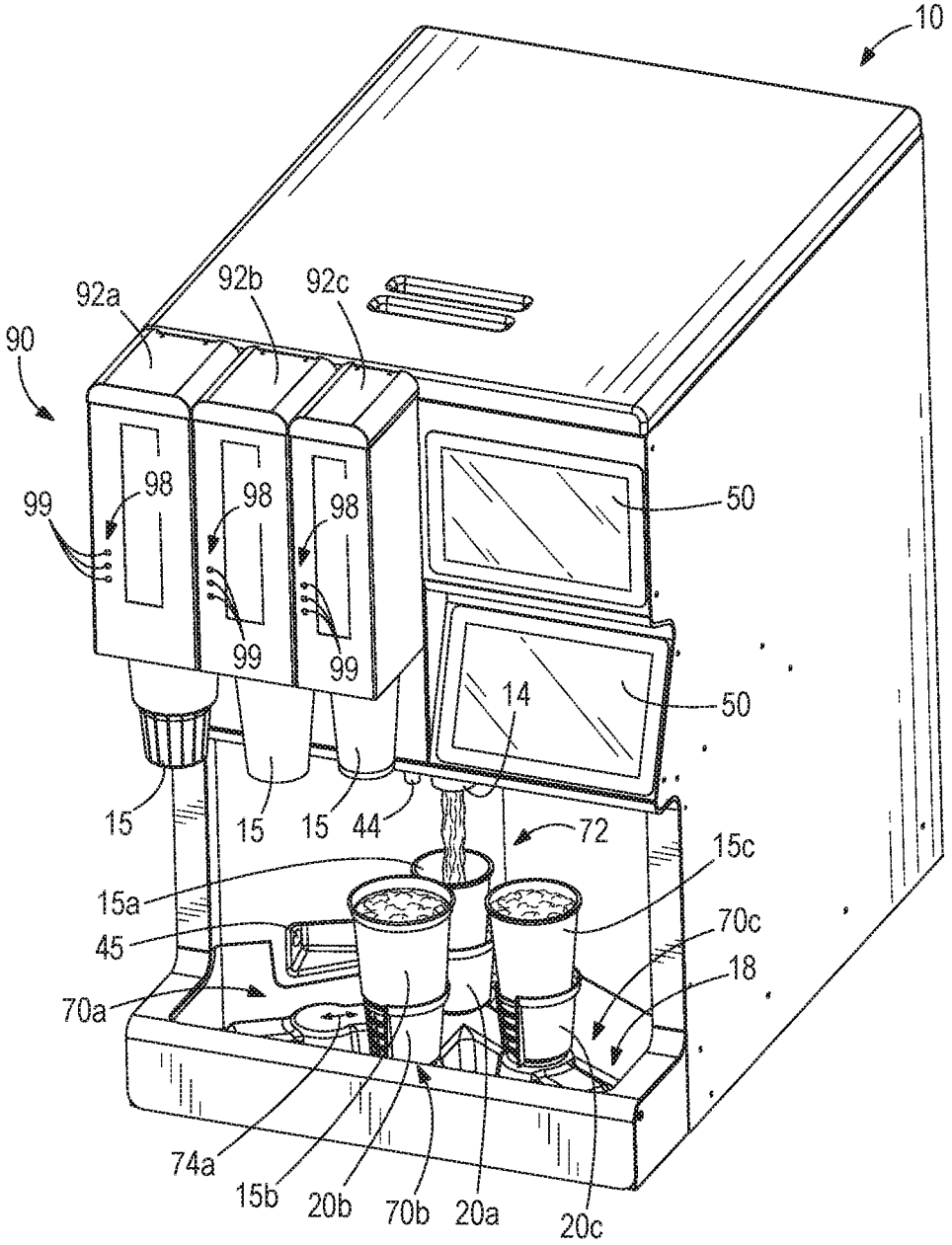

FIG. 20 depicts the first cup holder 20*a* as it is moved along the first radial path 74*a* toward the rear of the dispensing machine 10 from the first staging position 70*a* to the dispensing position 72. In the dispensing position 72, food product is dispensed by the dispenser 14 into the cup 15*a*.

Figure 21:
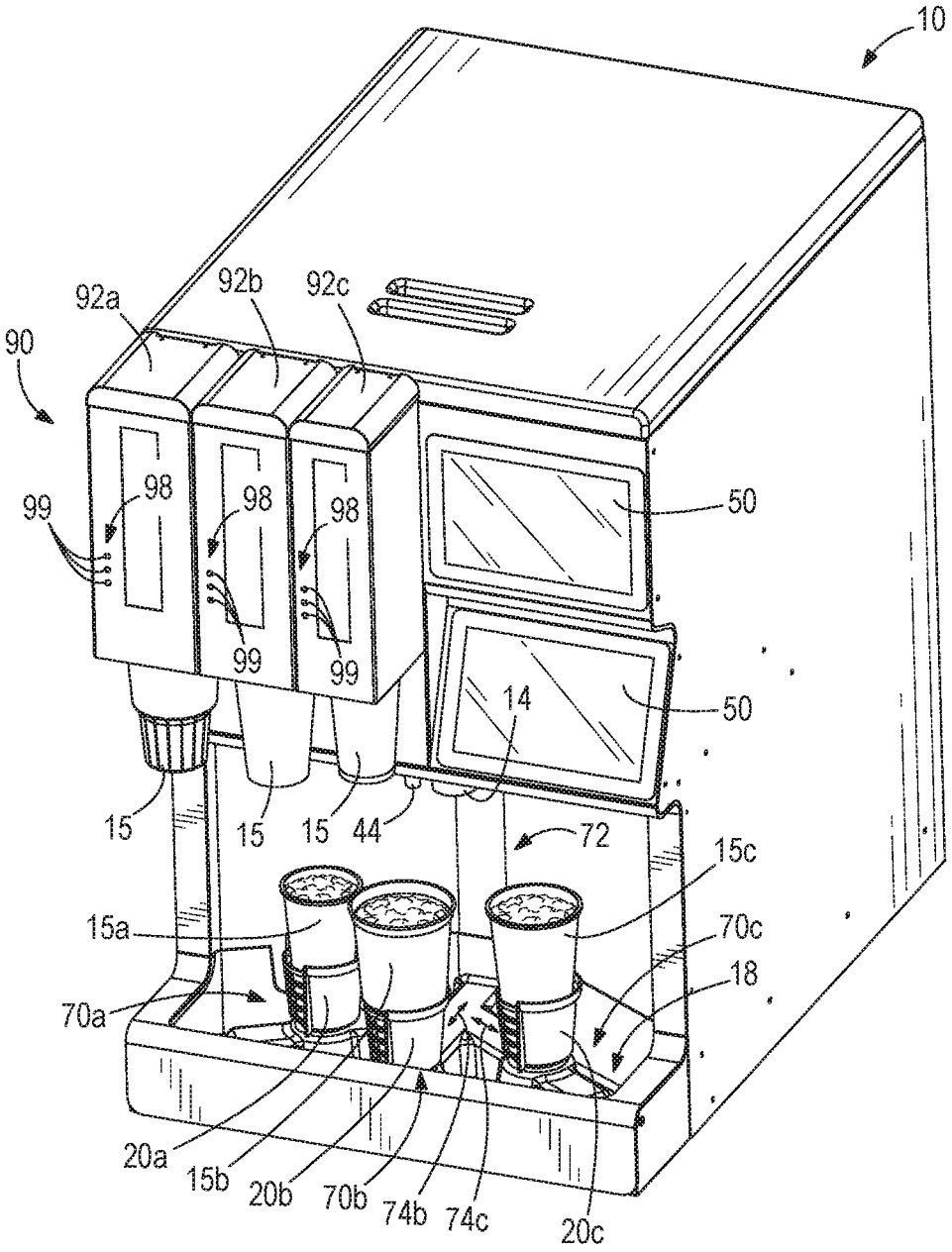

FIG. 21 depicts the first cup holder 20*a* as it is moved along the first radial path 74*a* toward the front of the dispensing machine 10 from the dispensing position 72 to the staging position 70*a*. The user can remove the cup 15*a* from the cup holder 20*a*

As discussed herein above, the present disclosure includes examples of dispensing machines 10. In one example, the dispensing machine 10 includes the cup holder 20 that comprises the target element 22, the second sensor 45 that senses the target element 22, and the controller 116. The cup holder 20 is configured to hold the cup 15 such that the cup 15 prevents the second sensor 45 from sensing at least a portion of the target element 22, and the controller 116 determines the size of the cup 15 based on the remaining portion of the target element 22 that is sensed by the second sensor 45 when the cup 15 is held by the cup holder 20. The controller 116 is configured to communicate with a memory 114 that stores a plurality of area values that are correlated to sizes of the cup 15, and the controller 116 is further configured to compare the remaining portions of the target element 22 to the plurality of area values to determine the size of the cup 15.

In certain examples, the dispensing machine 10 includes the food product dispenser 14, the first cup holder 20*a* configured to hold a first cup 15*a*, and the first drive mechanism 60 which moves the first cup holder 20*a* on the deck 18 between the first staging position 70*a* where the first cup 15*a* is received in the first cup holder 20*a* and the common dispensing position 72 where the cup 15*a* receives food product from the food product dispenser 14. The dispensing machine 10 includes the second cup holder 20*b* configured to hold the second cup 15*b* and the second drive mechanism (see FIG. 5) that moves the second cup holder 20*b* on the deck 18 between the second staging position 70*b* where the second cup 15*b* is received in the second cup holder 20*b* and the common dispensing position 72 where the cup 15*b* receives food product from the food product dispenser 14. The first and second drive mechanisms 60 travel along first and second radial paths 74*a*, 74*b*, respectively, with respect to the common dispensing position 72. The first cup holder 20*a* retains first driven magnet 38 and the first drive mechanism 60 retains a first driving magnet 62 such that the first driving magnet 38 couples first cup holder 20*a* to the first drive mechanism 60 through the deck 18 via magnetic attraction to the first driven magnet 38.

In certain examples, the dispensing machine 10 includes the cup dispenser 90 having the first cup housing 92*a* which is configured to hold a plurality of cups 15 and the indicator 98 which is configured to indicate a remaining number of cup dispenses to the user and comprises a plurality of lights 99. The first cup housing 92*a* includes the first outlet 94 through which the user can manually dispense cups 15 and the first dispense sensor 96 which is configured to sense cups that are dispensed through the outlet 94. The controller 116 is included with the dispensing machine 10 and is configured to receive beverage order data and to control the indicator 98 based on the cup dispenses sensed by the first dispense sensor 96 and the beverage order data. The controller 116 selectively controls each light 99 in the plurality of lights 99 such that the plurality of lights 99 indicates the remaining number of cup dispenses to the user, and the controller 116 calculates the remaining number of cup dispenses based on the difference between the cup dispenses sensed by the dispense sensor 96 and a number of beverages in the beverage order data.

The present disclosure thus provides methods of determining cup sizes for the dispensing machine 10. The methods can include: placing the cup 15 in the cup holder 20 which is configured to hold the cup 15 such that cup 15 prevents the second sensor 45 from sensing at least a portion of the target element 22 which is included with the cup holder 20; sensing a remaining portion of the target element 22 that is not obstructed by the cup 15; and operating the controller 116 to determine the size of the cup 15 based on the remaining portion of the target element 22. The methods may further include determining the size of the cup 15 by comparing the remaining portion of the target element 22 to a plurality of cup sizes that are correlated to sizes of the cup 15.

In the present description, certain terms have been used for brevity, clearness and understanding. No unnecessary imitations are to be implied therefrom beyond the requirement of the prior art because such terms are used for descriptive purposes only and are intended to be broadly construed. The different apparatuses and systems described herein may be used alone or in combination with other apparatuses and systems. Various equivalents, alternatives, and modifications are possible within the scope of the appended claims.

What is claimed is:

1. A food product dispensing machine for dispensing food product, the food product dispensing machine comprising:

a food product dispenser;

a first cup holder that is configured to hold a first cup;

a first drive mechanism that is configured to move the first cup holder on a deck between a first staging position for receiving the first cup in the first cup holder and a common dispensing position for receiving food product from the food product dispenser;

a second cup holder that is configured to hold a second cup; and a second drive mechanism that is configured to move the second cup holder on the deck between a second staging position for receiving the second cup in the second cup holder and the common dispensing position;

wherein the first and second drive mechanisms are configured to move the first and second cup holders along first and second radial paths, respectively, with respect to the common dispensing position.

2. The food product dispensing machine according to claim 1, wherein the first and second radial paths are straight line paths that are radially spaced apart from and transverse to each other.

3. The food product dispensing machine according to claim 1, further comprising a third cup holder that is configured to hold a third cup and a third drive mechanism that is configured to move the third cup holder on the deck between a third staging position for receiving the third cup in the third cup holder and the common dispensing position, wherein the third drive mechanism travels along a third radial path with respect to the common dispensing position.

4. The food product dispensing machine according to claim 3, wherein the first, second and third radial paths are straight line paths that are radially spaced apart from each other.

5. The food product dispensing machine according to claim 4, wherein the first, second and third staging positions spaced apart along an arc about the common dispensing position.

6. The food product dispensing machine according to claim 3, wherein each drive mechanism has a drive motor and a drive body connected to a lead screw, and wherein the drive motors are configured to rotate the lead screws in a first direction such that the drive bodies move toward the dispensing position and rotate the lead screws in an opposite, second direction such that the drive bodies move toward the staging positions.

7. The food product dispensing machine according to claim 6, wherein the lead screws extend along the radial paths.

8. The food product dispensing machine according to claim 7, wherein each drive mechanism has a limit switch configured to turn off power to the drive motor when the drive body contacts the limit switch.

9. The food product dispensing machine according to claim 4, wherein the first and second radial paths form a first acute angle, and wherein the second and third radial paths form a second acute angle.

10. The food product dispensing machine according to claim 9, wherein the first acute angle is equal to the second acute angle.

11. The food product dispensing machine according to claim 1, wherein the first cup holder comprises a semi-spherical protrusion that is configured to abut the deck and reduce friction between the first cup holder and the deck as the first cup holder is moved on the deck.

12. The food product dispensing machine according to claim 1, wherein the first drive mechanism and the second drive mechanism are positioned below the deck.

13. The food product dispensing machine according to claim 12, wherein the first cup holder retains a first driven magnet, wherein the first drive mechanism retains a first driving magnet; and wherein the first driving magnet magnetically couples the first cup holder through the deck to the first drive mechanism via magnetic attraction to the first driven magnet.

14. The food product dispensing machine according to claim 13, wherein the first cup holder retains second and third driven magnets that have a polarity that is opposite the first driven magnet; wherein the first drive mechanism also retains second and third driving magnets that have a polarity that is opposite the first driving magnet; and wherein the first driven magnet is magnetically coupled to the first driving magnet, the second driven magnet is magnetically coupled to the second driving magnet, and the third driven magnet is magnetically coupled to the third driving magnet.

15. The food product dispensing machine according to claim 14, wherein the first, second and third driving magnets form a triangular shape.

16. The food product dispensing machine according to claim 15, wherein the first cup holder has base and a plate coupled to the base, and wherein the plate retains the first driven magnet, the second driven magnet, and the third driven magnet in the base.

17. The food product dispensing machine according to claim 13, wherein the first cup holder has base and a plate coupled to the base, wherein the plate retains the first driven magnet in the base.

18. The food product dispensing machine according to claim 1, further comprising a controller configured to activate the first drive mechanism and the second drive mechanism to move the first cup holder and the second cup holder to the dispensing position.

19. A food product dispensing machine for dispensing food product, the food product dispensing machine comprising:

a food product dispenser;

a cup holder that is configured to hold a cup;

a drive mechanism that is configured to move the cup holder on a deck between a first staging position for receiving the cup in the cup holder and a dispensing position for receiving food product from the food product dispenser;

first, second and third driving magnets on the drive mechanism, the second and third driving magnets having a polarity that is opposite the first driving magnet;

first, second and third driven magnets on the cup holder, the second and third driven magnets having a polarity that is opposite the first driven magnet;

wherein the first driven magnet is magnetically coupled to the first driving magnet, the second driven magnet is magnetically coupled to the second driving magnet, and the third driven magnet is magnetically coupled to the third driving magnet;

wherein due to the polarities of the first, second and third drive magnets and polarities of the first, second and third driven magnets, the cup holder automatically aligns with the drive mechanism when the cup holder is placed on the deck.

20. The food product dispensing machine according to claim 19, wherein the drive mechanism is below the deck, and wherein the driven magnets are magnetically coupled to the driving magnets through the deck.

21. The food product dispensing machine according to claim 20, further comprising a controller configured to activate the drive mechanism to move the cup holder to the dispensing position.

22. The food product dispensing machine according to claim 20, wherein the cup holder comprises a semi-spherical protrusion configured to abut the deck and reduce friction between the cup holder and the deck as the cup holder is moved on the deck; and wherein the drive mechanism has a drive motor and a drive body connected to a lead screw, and wherein the drive motor is configured to rotate the lead screw in a first direction such that the drive body moves toward the dispensing position and rotate the lead screw in an opposite, second direction such that the drive body move toward the staging position.

* * * * *